US006729716B2

(12) United States Patent
Eguchi et al.

(10) Patent No.: US 6,729,716 B2
(45) Date of Patent: May 4, 2004

(54) LIQUID DROP JET HEAD AND INK JET RECORDING APPARATUS

(75) Inventors: Hirotoshi Eguchi, Kanagawa (JP); Shuzo Matsumoto, Kanagawa (JP); Kenichi Ogata, Kanagawa (JP); Kiyoshi Yamaguchi, Kanagawa (JP); Takayuki Hiyoshi, Kanagawa (JP); Mitsuru Shingyohuchi, Kanagawa (JP); Masanori Kusunoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/192,249

(22) Filed: Jul. 9, 2002

(65) Prior Publication Data

US 2003/0067513 A1 Apr. 10, 2003

(30) Foreign Application Priority Data

Jul. 9, 2001 (JP) ..... 2001-208098
Jul. 9, 2001 (JP) ..... 2001-208276

(51) Int. Cl.[7] ..... B41J 2/045
(52) U.S. Cl. ..... 347/70
(58) Field of Search ..... 347/68–72, 54

(56) References Cited

U.S. PATENT DOCUMENTS 5,539,982 A 7/1996 Hosono et al.
5,786,833 A 7/1998 Naka et al.
5,818,482 A 10/1998 Ohta et al.
5,880,763 A 3/1999 Tanaka et al.
6,343,853 B1 2/2002 Masubuchi et al.

FOREIGN PATENT DOCUMENTS

| | | | | |
|---|---|---|---|---|
| EP | 0563603 A2 | | 10/1993 | |
| EP | 1083048 A1 | * | 3/2001 | ..... 347/70 |
| JP | 8-25624 | | 1/1996 | |
| JP | 08025624 A | * | 1/1996 | ..... 347/70 |
| JP | 8-150716 | | 6/1996 | |
| JP | 9-174836 | | 7/1997 | |

OTHER PUBLICATIONS

English Translation of Japanese Document JP–08025624A.*

Copy of US patent application S.N. 09/948,280 filed Sep. 7, 2001.

Dec. 9, 2003 Japanese–language Examiner's Decision of Rejection and English–language translation thereof.

* cited by examiner

*Primary Examiner*—Russell Adams
*Assistant Examiner*—An H. Do
(74) *Attorney, Agent, or Firm*—Cooper & Dunham LLP

(57) ABSTRACT

A liquid drop jet head includes a nozzle, a liquid room, a vibration board forming a wall surface of the liquid room, driving element, a support substrate to which an end part of the driving element is connected without connecting to the vibration board, and a gap between the support substrate and the vibration board at a position corresponding to a partition of the liquid room, wherein the vibration board includes a thin part and a thick part and the area of the thin part is divided by the thick part with which the driving element comes in contact.

34 Claims, 17 Drawing Sheets

LIQUID DROP JET HEAD AND INK JET RECORDING APPARATUS

BACKGROUND OF THE INVENTION

1. Field of the Invention

The present invention relates to liquid drop jet heads and ink jet recording apparatuses.

2. Description of the Related Art

An ink jet recording apparatus is used as a picture recording apparatus or picture forming apparatus such as a printer, facsimile, copy machine, or plotter. An ink jet head is used for the ink jet recording apparatus as a liquid drop jet head. The ink jet head includes a nozzle, a liquid room, and a driving means (pressure generating means). An ink drop is jetted out by the nozzle. The nozzle is connected to the liquid room. The liquid room is called a pressurized liquid room, pressure room, jet room, or ink channel. The ink in the liquid room is pressurized by the driving means (pressure generating means). The ink drop is jetted out from the nozzle due to the pressure in the liquid room generated by the pressure generating means. Although there are several types of liquid drop jet heads such as a liquid drop jet head jetting a liquid resist as a liquid drop or a liquid drop jet head jetting a test material of DNA as a liquid drop, the ink jet head will be described.

A piezo type ink jet head is known as an ink jet head. An electromechanical transducer element such as a piezoelectric element as a driving means generating pressure by which the ink in the liquid room is pressurized is used in the piezo type ink jet head. A vibration board that is capable of elastically deforming and forms a wall surface of the liquid room is deformed by a deformation of the driving means, so that the volume is decreased/pressure is increased in the liquid room and the ink drop is jetted, in the piezo type ink jet head. See Japanese Laid-Open Patent Application, No. 2-51734.

In the above mentioned ink jet head, the piezoelectric element is deformed by charging or discharging so that the vibration board coming in contact with the piezoelectric element is deformed. The pressure inside of the pressurized liquid room increases due to the vibration board deforming so as to contract the volume of the pressurized liquid room so that the ink drop is jetted from the nozzle. After the ink drop is jetted, the piezoelectric element is deformed so as to deform the vibration board and expand the volume of the pressurized liquid room.

One example of the above mentioned ink jet head is shown in FIGS. 1 and 2. FIG. 1 is a cross sectional view along a long side direction of the liquid room of the ink jet head according to the conventional art. FIG. 2 is a cross sectional view along a short side direction of the liquid room of the ink jet head according to the conventional art.

In this ink jet head, a pressurized liquid room 114 connecting to a nozzle 113 jetting an ink drop 122 and a common liquid room 119 supplying the ink through a connecting part 120 to the pressurized room 114 are formed by connecting the liquid room substrate 111 and the nozzle board 118, and a piezoelectric element 117 provided on a base board 112 is connected to an outside surface of the vibration board 116 forming a part of a wall surface of the pressurized room 114.

The vibration board 116 is elastically deformed based on a deformation of the piezoelectric element 117. However, the vibration board 116 generally has a smaller rigidity (larger compliance) than other walls forming the pressurized room 114. Furthermore, the common liquid room 119 is connected to an ink tank not shown in FIGS. 1 and 2. A support member 121 is provided between the liquid room board 111 and a base board 112.

The piezoelectric element 117 is deformed by applying a voltage from a driving circuit not shown in FIGS. 1 and 2 to the piezoelectric element 117 so that the vibration board 116 is deformed so as to increase or decrease the volume of the pressurized liquid room 114. In a case where the volume of the pressurized room 114 is increased, the inside pressure of the pressurized liquid room 114 is reduced so that the ink is filled up through a connecting part 120 from the common liquid room 119 to the pressurized liquid room 114.

After that a driving force is implemented so as to increase the inside pressure of the pressurized liquid room 114. That is, in a case where the piezoelectric element 117 is driven so as to reduce the volume of the pressurized liquid room 114, the inside pressure of the pressurized liquid room 114 is increased. Because of this, ink is pushed out from the nozzle 113 and sprayed as the ink drop 122 to adhere to a recording medium such as paper so that recording can be implemented.

Thus, the ink drop in the ink jet head using the vibration board is formed based on a deformation of the vibration board. A connection part with the piezoelectric element as a driving resource is an important factor as a capability for the ink jet head.

Because of this, as disclosed in Japanese Patent No. 3147132 or Japanese Patent No. 3070625, there is a technology wherein a convex part having an island shape for connecting with the piezoelectric element is formed on the vibration board.

A structure of the above mentioned conventional ink jet head is described with reference to FIG. 3 through FIG. 6. FIG. 3 is a perspective view of the conventional ink jet head. FIG. 4 is a expanded view of a part shown in FIG. 3. FIG. 5 is a perspective view of the vibration board of another example of the conventional ink jet head. FIG. 6 is a rough perspective view of the conventional ink jet head. In FIG. 3 through FIG. 6, parts that are the same as the parts shown in FIG. 1 and FIG. 2 are given the same reference numerals, and explanation thereof will be simplified.

In this ink jet head, a concave part 123 is formed at the vibration board 116 forming one of the wall surfaces of the pressurized liquid room 114 so that a concave part 123 is formed. A convex part 124 having as island shape is formed as a thick part at a position where the piezoelectric element 117 comes in contact with the vibration board 116. That is, the thin part 126 surrounds all of the convex part 124 having the island shape as a thick part with a substantially constant thickness.

The piezoelectric element 117 corresponds to the pressurized liquid room 114. The concave part 123, which surrounds the convex part 124 having the island shape that comes in contact with the piezoelectric element 117, is divided by the thick part 125. The thin part 126 is formed by the vibration board 116 shown in FIG. 5. The convex part 124 having the island shape is formed on the thin part 126 as a thick part.

It is possible to reduce the amount of vibration of the piezoelectric element 117 that is transferred to other neighboring pressurized liquid rooms by making the piezoelectric element 117 come in contact with the convex part 124 having the island shape and driving the piezoelectric element. Furthermore, it is possible to convert the deformation of the piezoelectric element to the change of the volume of the pressurized liquid room efficiently, namely by a pressure change.

However, according to the above mentioned conventional ink jet head, it is necessary for the convex part 124 having the island shape formed on the vibration board 116 to be formed having a constant distance from the border of the division of the pressurized liquid rooms 114. Accordingly, it is necessary to form the thin part 126 having a constant width surrounding the convex part 124 having the island shape. Hence, it is required to have higher measuring precision or positioning precision.

Furthermore, the long side of the convex part 124 having the island shape is a longer than the long side of the head end part of the piezoelectric element 117 In addition, it is necessary to provide space for the thin part 126 so that it is difficult to make the whole of the ink jet head small. Hence, there is a problem to correspond to an arrangement of pressurized liquid rooms 114 with a high density. Furthermore, since a change of the volume inside of the pressurized liquid room 114 is decided based on the size of the convex part 124 and the amount of the deformation of the piezoelectric element 117, it is necessary to make the dimensions of the convex part 124 with high precision. However, it is difficult to make the dimensions of the convex part 124 with high precision, so the yield rate is reduced and manufacturing cost is increased.

Furthermore, the vibration board 116 having a large area of the thin part 126 is one element of the pressurized liquid room 114. The pressurized liquid room 114 has small rigidity (large compliance) so that an efficiency to increase the inside pressure of the pressurized liquid room 114 is worse so that the controllability of a meniscus at the time of ink drop jetting declines.

In addition, when the piezoelectric element 117 is driven, a strain based on an elastic deformation occurs at the thin part 126 surrounding the convex part 124 having the island shape. The vibration board 116 may be broken due to the concentration of the stress occurring in conjunction with an unexpected condition such as scatter at the time of forming the convex part 124 and the thin part 126. In order to form a large number of the pressurized liquid rooms 114 without scatter, the manufacturing process becomes complicated so that various apparatuses are required to be improved and an increase of the cost may occur.

SUMMARY OF THE INVENTION

Accordingly, it is a general object of the present invention to provide a novel and useful liquid drop jet head and ink jet recording apparatus in which one or more of the problems described above are eliminated.

Another and more specific object of the present invention is to provide a liquid drop jet head by which the inside pressure of the liquid room can be increased and decreased without reducing the efficiency of the driving means, controllability of the meniscus and a capability of the jetting the liquid drop can be improved, the size of the liquid drop jetting head is made small, and occurrence of scatter can be reduced. It is also an object to provide an ink jet head recording apparatus in which the liquid drop jet head is used so that picture quality is improved.

The above object is achieved by a liquid drop jet head, including a nozzle jetting a liquid drop, a liquid room connected to the nozzle, a vibration board forming a wall surface of at least a part of the liquid room, driving means generating a pressure pressuring a liquid provided in the liquid room by coming in contact with the vibration board, a support substrate to which an end part of the driving means is connected without connecting to the vibration board, and a gap between the support substrate and the vibration board at a position corresponding to a partition of the liquid room, wherein the vibration board comprises a thin part and a thick part and the area of the thin part is divided by the thick part with which the driving means comes in contact.

The above object is also achieved by a liquid drop jet head, including a nozzle jetting a liquid drop, a liquid room connected to the nozzle, a vibration board forming a wall surface of at least a part of the liquid room, driving means generating a pressure pressuring a liquid provided in the liquid room by coming in contact with the vibration board, a support substrate to which an end part of the driving means is connected without connecting to the vibration board, and a support member connecting the support substrate and the vibration board at a position corresponding to a partition of the liquid room, wherein the vibration board comprises a thin part and a thick part and the area of the thin part is divided by the thick part with which the driving means comes in contact.

According to the present invention, it is possible to improve the rigidity of the liquid room and the controllability of drop jetting so that scatter can be reduced and a stable drop jetting capability can be achieved.

The thick part may project to a side where the driving means facing the liquid room comes in contact.

According to the present invention, a liquid flow in a side of the liquid room is prevented from being blocked.

The thick part may be provided along a long side direction of the liquid room.

According to the present invention, it is possible to improve rigidity of the liquid room and to better control the displacement amount of the vibration board.

The thin part whose area may be divided by the thick part has a long and narrow configuration along the long side direction of the liquid room.

According to the present invention, it is possible to better control the displacement amount of the vibration board.

The length of the thin part in the long side direction of the liquid room may be longer than the length of the driving means that comes in contact with the thick part in the long side direction of the liquid room.

According to the present invention, it is possible to control a change of the capability due to a contact position gap of the thick part and the driving means so that it is possible to better control the a displacement amount of the vibration board.

The area of the thin part may be formed at a symmetrical position from the thick part.

According to the present invention, deviation of the change of pressure inside of the liquid room is prevented so that it is possible to prevent mutual interference.

The thick part of the vibration board, surrounded by the thin part, may have a substantially constant thickness.

According to the present invention, it is possible to reduce manufacturing cost and obtain high precision.

The driving means may comprise a piezoelectric element whose displacement in a normal direction of the vibration board is in a d33 direction.

According to the present invention, it is possible to drive the liquid drop jet head at a high speed.

The piezoelectric element may have a structure in which a plurality of layers of piezoelectric elements and electrode layers are stacked, and an end part in the long side direction of the liquid room may have an inactive area where an electric field is not generated and which faces and comes in contact with the partition of the liquid room.

According to the present invention, it is possible to control a change of a capability due to a contact position gap.

The inactive area of the piezoelectric element may face and come in contact with the partition of both ends in the long side direction of the liquid room.

According to the present invention, it is possible to improve rigidity of the whole liquid drop jet head by having an inactive area function as a support member for the vibration board and the base substrate.

An active area of the piezoelectric element may not exist in an area facing the partition of both ends in the long side direction of the liquid room.

According to the present invention, vibration is prevented from giving the partition unnecessary displacement so that a block against displacement efficiency of the piezoelectric element is avoided.

The inactive area of the piezoelectric element may exist in an area facing a driving area of the vibration board.

According to the present invention, it is possible to prevent scatter of a capability against the position gap at the precise time of contacting.

The piezoelectric element may have a structure in which the length in the long side direction of the liquid room at a position where an end part of the piezoelectric element comes in contact with the vibration board is shorter than the length in the long side direction of the liquid room.

According to the present invention, it is possible to further improve head rigidity by increasing thickness of the liquid room at a part corresponding to surrounding a position where an end part of the piezoelectric element comes in contact with the vibration board more than the thickness of the thick part.

The piezoelectric element may have a structure in which the length of the piezoelectric element in the long side direction of the liquid room at a position where the piezoelectric element comes in contact with the vibration board is shorter than the length of the thick part of the vibration board in the long side direction of the liquid room.

According to the present invention, it is possible to contact the piezoelectric element with the thick part precisely.

The piezoelectric element may have a structure in which the length of the piezoelectric element in a short side direction of the liquid room at a position where the piezoelectric element comes in contact with the vibration board is longer than the length of the thick part of the vibration board in the short side direction of the liquid room.

According to the present invention, it is possible to reduce scatter due to a positioning gap at the time of contacting.

The thick part of the vibration board may comprise a first thick part with which the driving means comes in contact and a second thick part having a different thickness from the thin part and connected to the first thick part and the partition of the liquid room.

According to the present invention, it is possible to reduce rigidity of a part where the piezoelectric element does not come in contact and improve rigidity of the whole liquid room.

The above mentioned object is also achieved by an ink jet recording apparatus, including an ink jet head jetting the ink drop, the ink jet head including a nozzle jetting the ink drop, a liquid room connected to the nozzle, a vibration board forming a wall surface of at least a part of the liquid room, driving means generating a pressure pressuring a liquid ink provided in the liquid room by coming in contact with the vibration board, a support substrate to which an end part of the driving means is connected without connecting to the vibration board, and a gap between the support substrate and the vibration board at a position corresponding to a partition of the liquid room, wherein the vibration board comprises a thin part and a thick part, and the area of the thin part is divided by the thick part with which the driving means comes in contact.

According to the present invention, it is possible to stably record a picture having high quality.

Other objects, features, and advantages of the present invention will become more apparent from the following detailed description when read in conjunction with the accompanying drawings.

DETAILED DESCRIPTION OF THE PREFERRED EMBODIMENTS

A description will now be given, with reference to FIGS. 7 through 27, of embodiments of the present invention.

Figure 1:
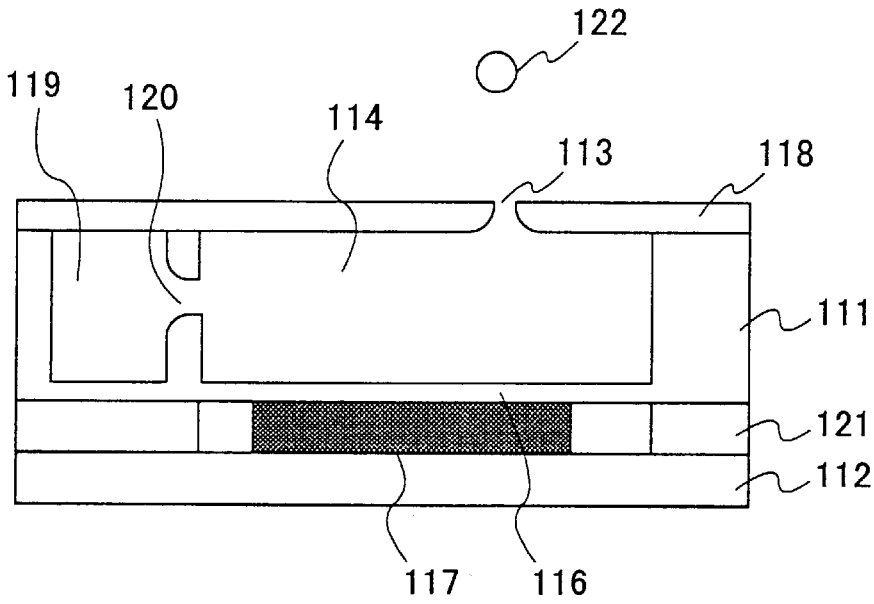
FIG.1 PRIOR ART
FIG. 1 is a cross sectional view along a long side direction of the liquid room of the ink jet head according to the conventional art.
Figure 2:
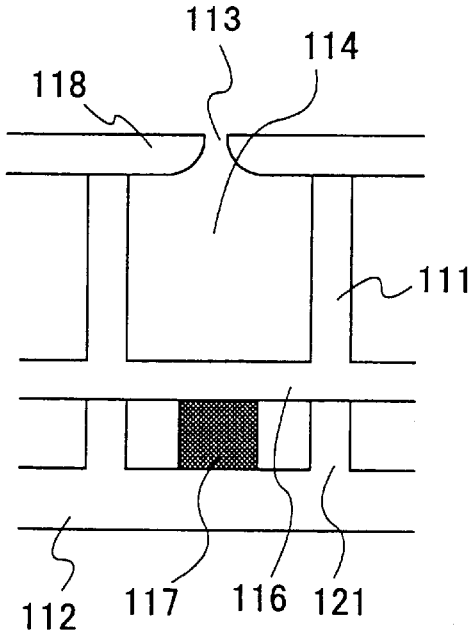
FIG.2 PRIOR ART
FIG. 2 is a cross sectional view along a short side direction of the liquid room of the ink jet head according to the conventional art.
Figure 3:
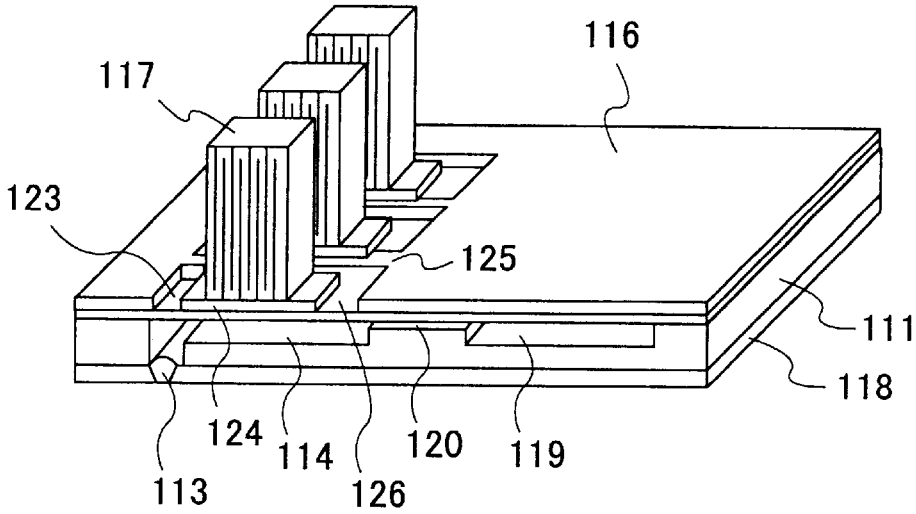
FIG.3 PRIOR ART
FIG. 3 is a perspective view of the conventional ink jet head.
Figure 4:
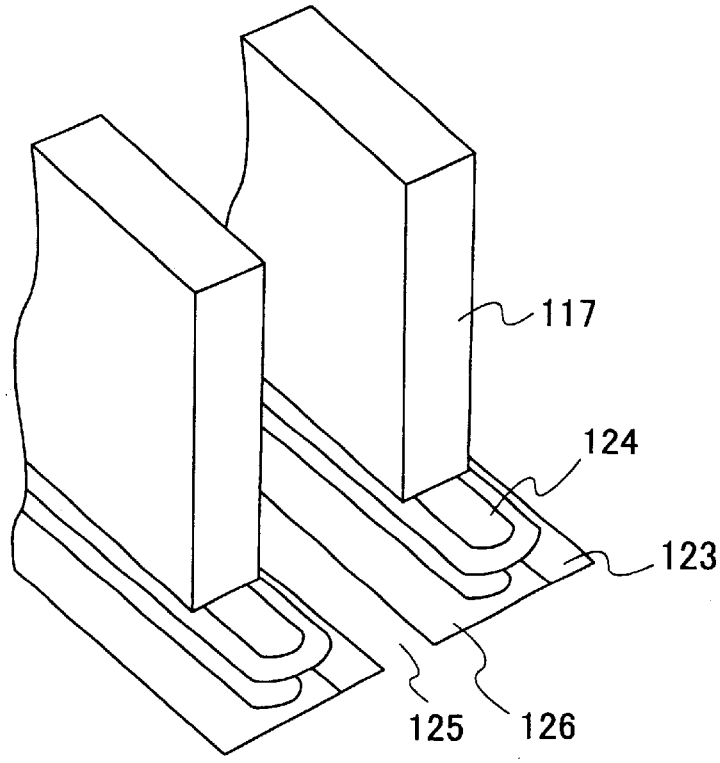
FIG.4 PRIOR ART
FIG. 4 is a expanded view of a part shown in FIG. 3.
Figure 5:
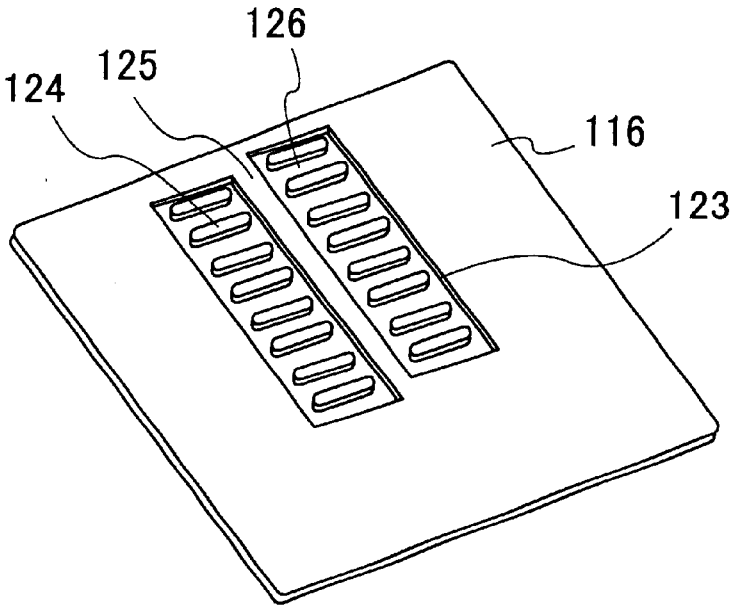
FIG.5 PRIOR ART
FIG. 5 is a perspective view of the vibration board of another example of the conventional ink jet head.
Figure 7:
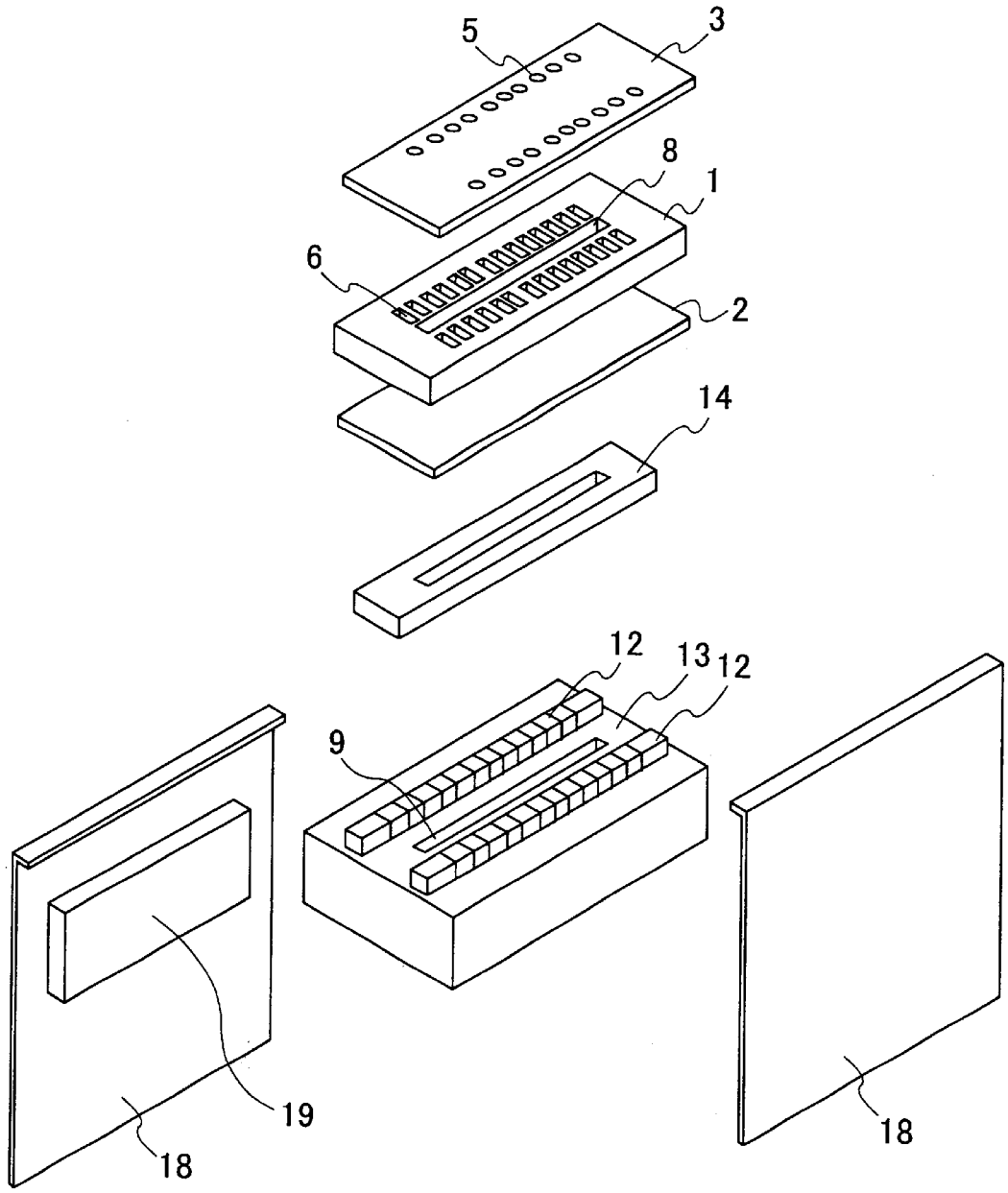
FIG. 7 is an exploded perspective view of the ink jet head of the first embodiment of the liquid drop jet head of the present invention.
Figure 8:
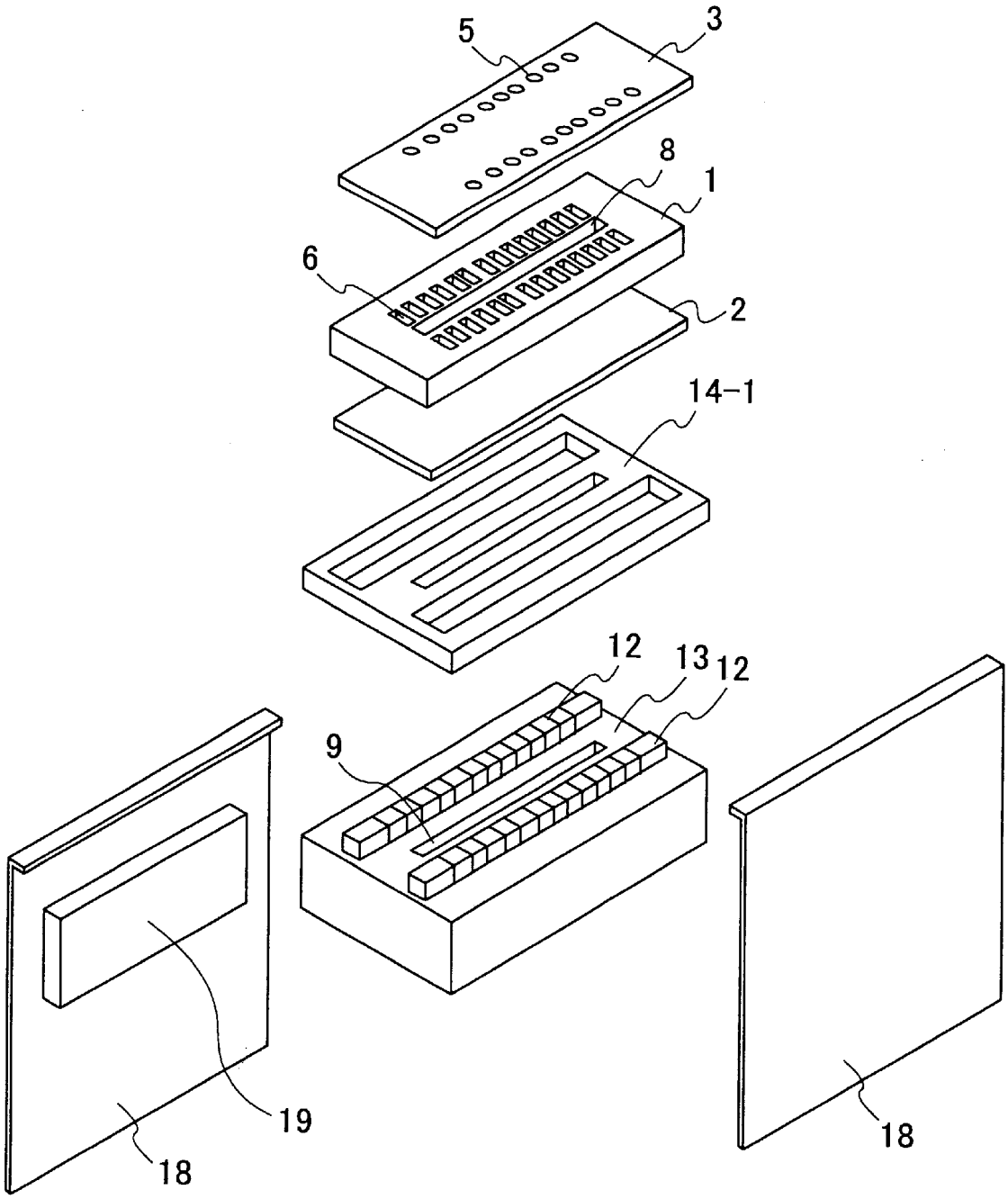
FIG. 8 is a cross sectional view along the long side direction of the liquid room of the ink jet head of the first embodiment of the liquid drop jet head of the present invention.
Figure 9:
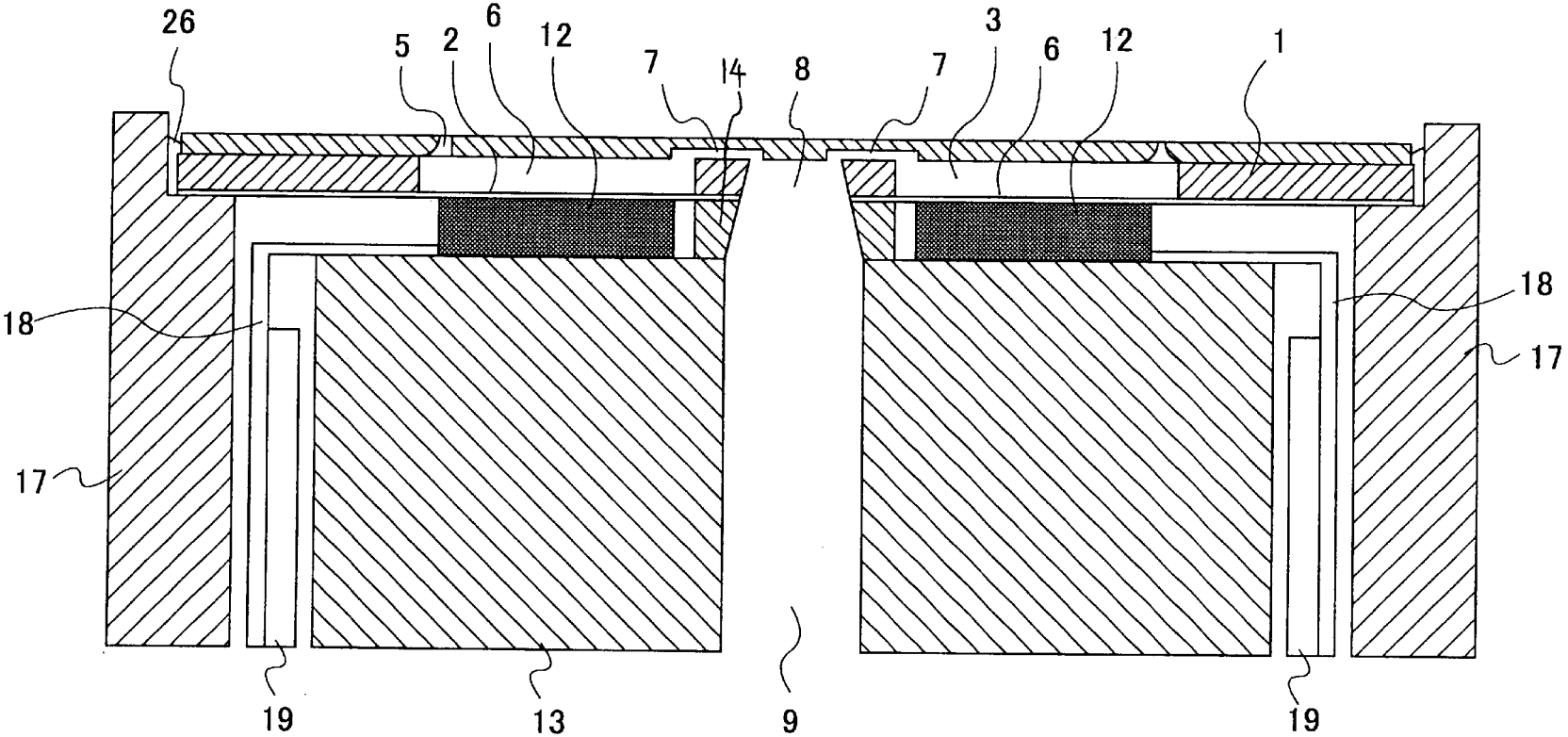
FIG. 9 is a expanded view of a part shown in FIG. 2.
Figure 10:
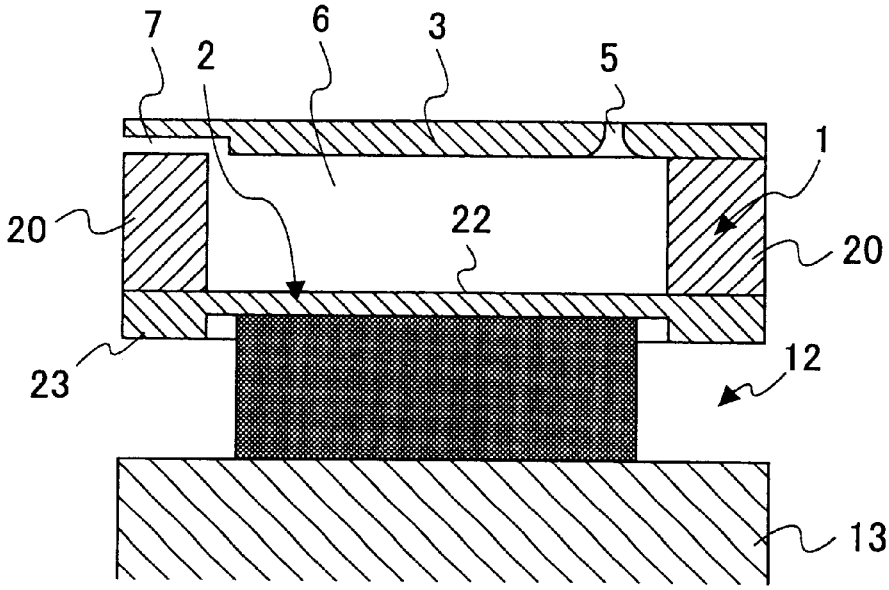
FIG. 10 is a cross sectional view along the short side direction of the liquid room of the ink jet head of the first embodiment of the liquid drop jet head of the present invention.
Figure 11:
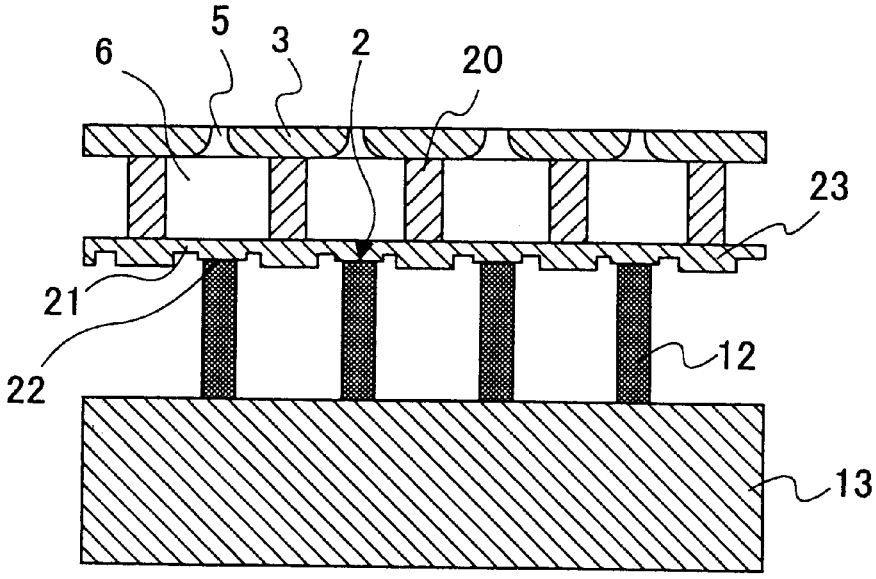
FIG. 11 is a partially expanded perspective of the ink jet head of the first embodiment of the liquid drop jet head of the present invention.
Figure 12:
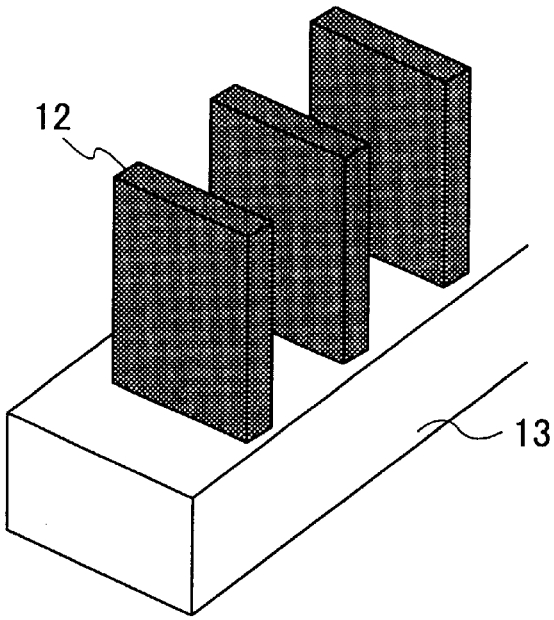
FIG. 12 is an expanded perspective view of a part of the liquid drop jet head of the present invention.

First, a first embodiment of the present invention will be described with reference to FIGS. 7 through 11. FIG. 7 is an exploded perspective view of the ink jet head of the first embodiment of the liquid drop jet head of the present invention. FIG. 8 is a cross sectional view along the long side direction of the liquid room of the ink jet head of the first embodiment of the liquid drop jet head of the present invention. FIG. 9 is an expanded view of the part shown in FIG. 2. FIG. 10 is a cross sectional view along the short side direction of the liquid room of the ink jet head of the first embodiment of the liquid drop jet head of the present invention. FIG. 11 is a partially expanded perspective of the ink jet head of the first embodiment of the liquid drop jet head of the present invention.

The ink jet head includes a path forming substrate (a liquid substrate) 1, a vibration board 2, and a nozzle board 3. The path forming substrate (the liquid substrate) 1 is formed by a single crystal silicon substrate. The vibration board 2 is connected to the lower surface of the path forming substrate (the liquid substrate) 1. The nozzle board 3 is connected to the upper surface of the path forming substrate (the liquid substrate) 1. A pressurized liquid room 6, which is a path (an ink liquid room) connected to a nozzle 5 jetting the ink drop, and a common liquid room 8 supplying the ink to the pressurized liquid room 6 through an ink supply path 7, which is a fluid resistance part, are formed by the path forming substrate 1, the vibration board 2, and the nozzle board 3.

A stacked type piezoelectric element 12 as a driving means is connected at an outside surface of the vibration board 2 corresponding to the respective pressurized liquid room 6. The stacked type piezoelectric element 12 is fixed by connection to the base board 13.

An ink supply opening forming member 14 is connected to the base board 13 in the center area between lines of the piezoelectric elements 12 of the base board 13. Or, as shown in FIG. 8, a spacer member 14-1 is connected to the base board 13 around the lines of the piezoelectric elements 12. The spacer member 14-1 also serves as the ink supply opening forming member.

The ink supply opening forming member 14 can be formed with the base board 13 in a body by etching the base board 13.

The piezoelectric element 12 is made by stacking a piezoelectric material layer and an inside electrode reciprocally. In this case, ink in the pressurized liquid room 6 may be put under pressure by using displacement in a d33 direction (a perpendicular direction to a stacked direction) as a piezoelectric direction of the piezoelectric element 12. Or, the ink in the pressurized liquid room 6 may be put under pressure by using a displacement of a d31 direction (a paralled direction to a stacked direction) as a piezoelectric direction of the piezoelectric element 12.

In a case shown in FIG. 8, ink in the pressurized liquid room 6 may be put under pressure by using displacement in a d33 direction (a perpendicular direction to the stacked direction) as a piezoelectric direction of the piezoelectric element 12. Or, the ink in the pressurized liquid room 6 may be pressurized by using displacement in a d31 direction (a parallel direction to a stacked direction) as a piezoelectric direction of the piezoelectric element 12.

A piercing hole forming the ink supply opening 9 supplying the ink from outside to the common liquid room 8 is formed at a base board 13 and the ink supply opening forming member 14.

An external circumference part of the path forming substrate 1 and a lower surface side external edge part of the vibration board 2 are adhesively connected to a head frame 17 formed by injection molding with epoxy group resin or ployphenylene sulfide. The head frame 17 and the base substrate 13 are fixed to each other by an adhesive at a part not shown in FIGS. 1–7. The head frame 17 may be divided into two parts or consist of one part.

A FPC cable 18 is connected to the piezoelectric element 12 by solder connection, ACF (anisotropy conductive film) connection, or wire bonding in order to give a driving signal. A driving circuit (driver IC) 19 is mounted on the FPC cable 18 in order to apply a driving wave to respective piezoelectric elements 12 selectively.

Piercing holes as respective pressurized liquid rooms 6, a groove part as the ink supply path 7 and a piercing hole as the common liquid room are formed at the path forming substrate 1, by anisotrophy etching of a single crystal substrate of a crystal surface direction (110) with an alkaline etching liquid such as potassium hydroxide aqueous solution (KOH). In this case, the respective common liquid rooms 6 are divided by the partition 20.

The vibration board 2 is made of a metal plate such as nickel. The vibration board 2 may be made of a resin member or a stacked member of the resin member and a metal member. In the case shown in FIG. 8, the vibration board 2 is made of a metal plate of nickel by an electroforming method. The vibration board 2 may be made of a resin member or a stacked member of resin and a metal other than nickel.

A thin part 21 to be displaced easily and a center thick part 22 to contact the piezoelectric element 12 are provided at a corresponding part to the pressurized liquid room 6 of this vibration board 2. A surrounding thick part 23 is formed corresponding to the partition 20. A flat surface side of the surrounding thick part 23 is connected adhesively to the path forming substrate 1 and the surrounding thick part 23 is connected to the head frame 17 adhesively.

A support member is not provided, but there is a gap between the surrounding thick part 23 corresponding to the liquid room partition 20 of the vibration board 2 (the partition 20 between each of the pressurized liquid room 6) and the base substrate 13. In this case, rigidity of the pressurized liquid room 6, namely the partition 20, the nozzle board 3, and vibration board 2 becomes high and the strength of the respective connection parts sufficiently provided, in order to maintain rigidity of the above mentioned pressurized liquid room 6 and secure an efficient displacement of the center thick part 22 of the vibration board 2 due to displacement of the piezoelectric element 12.

Figure 6:
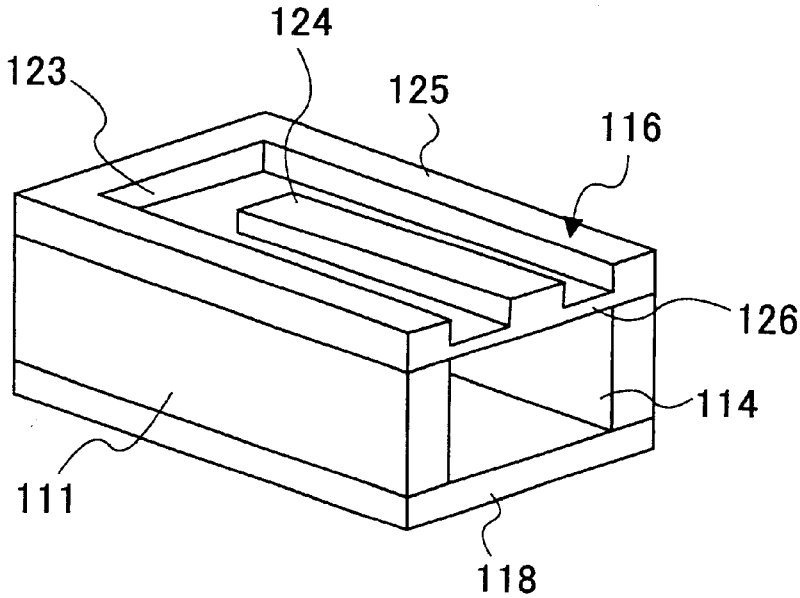
FIG.6 PRIOR ART
FIG. 6 is a schematic perspective view of the conventional ink jet head.
Figure 13:
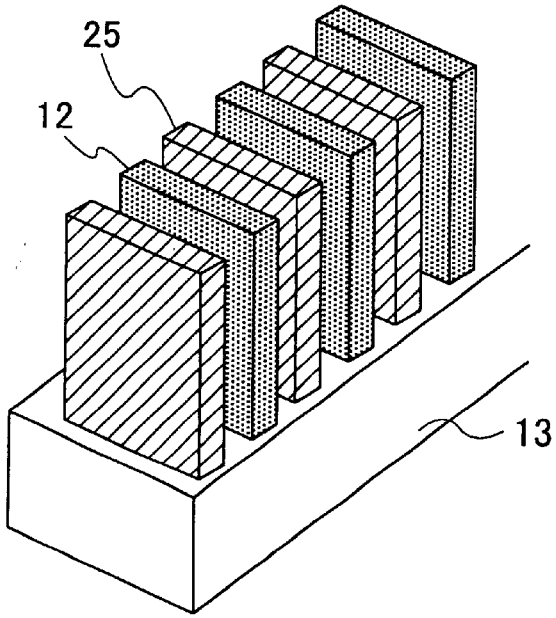
FIG. 13 is an expanded perspective view of a part of the liquid drop jet head of the present invention of a case shown in FIG. 6.

In a case shown in FIG. 6, as shown in FIG. 13, a support member 25 is provided between the surrounding thick part 23 corresponding to the liquid room partition 20 of the vibration board 2 and the base substrate 13. Because of this, the vibration board 2 and the base substrate 13 are connected by both the piezoelectric elements 12 and the support members 25 so that rigidity of the pressurized liquid room 6 can be maintained and the efficiency of displacement of the center thick part 22 of the vibration board 2 due to the displacement of the piezoelectric elements 12 can be assured. The support member 25 may have the same structure as the piezoelectric elements 12.

The nozzle board 3 has a nozzle 5 that has a diameter of 10 through 30 $\mu$m as corresponding to the respective pressurized liquid room 6 and connects to the path forming substrate 1 adhesively. As for the nozzle board 3, a metal such as stainless or nickel, a combination of the metal and a resin such as a polyimide resin film, silicon and combinations thereof can be used. A plated film or a repellent film by a well known method such as a water repellent coating is formed on the nozzle surface (a surface in the jetting direction: jetting surface) in order to repel the ink. A sealing material 26 is filled between the nozzle board 3 and the head frame 17. The sealing material 26 serves as an adhesive, too.

In the above mentioned ink jet head, a driving pulse voltage of 20 through 50 V is applied to the piezoelectric elements 12 selectively so that the piezoelectric elements 12 are displaced in a stacked direction (in the case where a direction of d33 is used) and the vibration board 2 is displaced in the direction of the nozzle board 5. Because of this, ink provided in the pressurized liquid room 6 is pressurized by a change of a capacity/volume of the pressurized liquid room 6 so that an ink drop is jetted from the nozzle 5.

Liquid pressure in the pressurized liquid room 6 is reduced based on jetting of the ink drop. A slightly negative pressure occurs in the pressurized liquid room 6 due to inertia of the ink flow in this case. Under this condition, the vibration board 2 is returned to the primary position by turning off the voltage to the piezoelectric elements 12, and the pressurized liquid room 6 has a primary configuration so that a negative pressure is generated. In this case, the ink is filled up in the pressurized liquid room 6 from the ink supply opening 9 through the common liquid room 8 and the ink supply path 7 as a fluid resistance part. After the vibration of the ink meniscus of the nozzle 5 is attenuated and stabled, the pulse voltage is applied to the piezoelectric elements 12 again in order to jet the next ink drop so that the ink drop is jetted.

Figure 14:
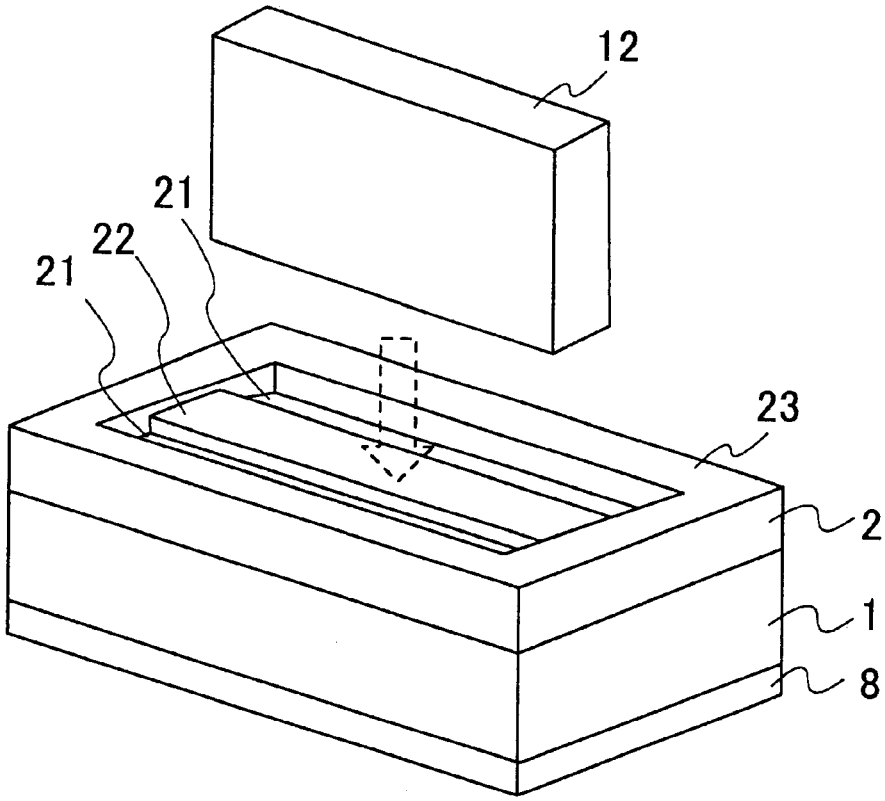
FIG. 14 is an expanded schematic perspective view of a part of the liquid drop jet head of the present invention.

Here, details of the structure of the vibration board 2 in the above mentioned ink jet head will be described with reference to FIG. 14. FIG. 14 is a schematic perspective view of a contact part of the piezoelectric element 12 to jet the ink drop.

The vibration board 2 comprises the thin part 21, a center thick part 22 and surrounding part 23. The area of the thin part 21 is divided by the center thick part 22 with which the piezoelectric element 12 comes in contact (connects, in this embodiment), so as to form two thin parts 21.

The center thick part 22 is formed along a long side direction of the pressurized liquid room 6 (a long side direction of the liquid room). Each of the thin parts 21 is provided at a symmetrical position against the center thick part 22 and has a long and narrow configuration along the long side direction of the pressurized liquid room 6. Because of this, a change of the pressure in the pressurized liquid room 6 at the time of driving becomes symmetric so that it is possible to prevent mutual interference.

The surrounding thick part 23 is a thick part to segregate the thin parts 21 and the center thick parts 22 with the respective pressurized liquid room 6. The surrounding center thick part 23 and the thickness of the center thick part 22 are formed so that the thickness of the center thick part 22 is less than the thickness of the surrounding center thick part 23.

The piezoelectric element 12 is connected to the center thick part 22 of the vibration board 2 so as to give the driving signal from the driver IC. Because of this, the piezoelectric element 12 is expanded and contracted and the ink drop is jetted by controlling the inside pressure of the pressurized liquid room 6 properly. Since the displacement of the piezoelectric element 12 is applied to the displacement of the center thick part 22, a numerical value simulation is implemented with respect to a reduction of the efficiency.

Four kinds of samples, different only in configuration of the center thick part where the piezoelectric element comes in contact, are used in this simulation. That is, the thin parts are divided at the center thick part as in this embodiment of the present invention, a conventional thick part that has a convex part having an island shape as a comparison example 1 (See FIG. 6), a thick part that has a convex part having the island shape and a narrower width as a comparison example 2, and a thick part that has a convex part having the island shape and a more narrow width as a comparison example 3 are used in this simulation, as shown in FIG. 15.

Figure 16:
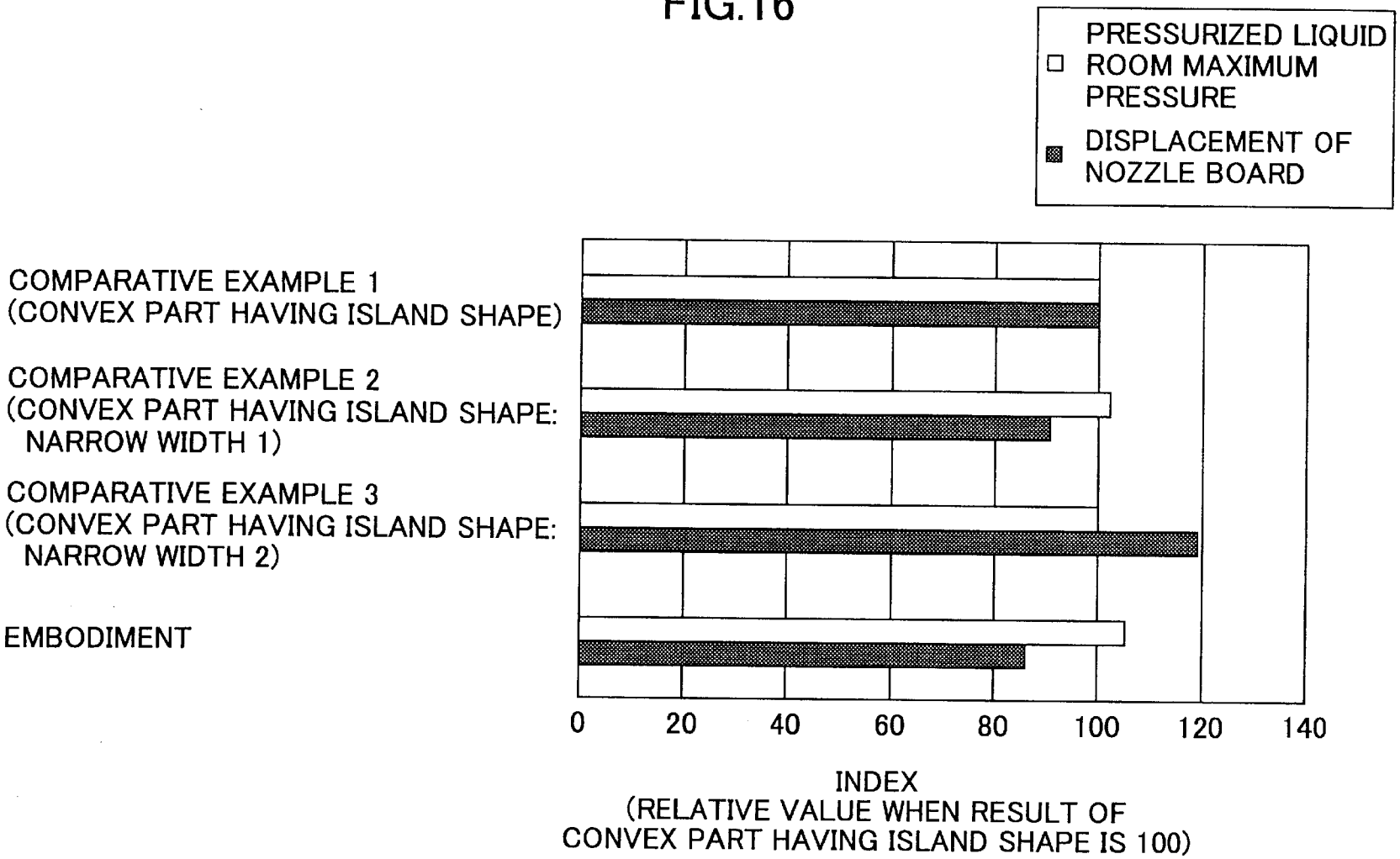
FIG. 16 is a view showing additional result of the simulation of the liquid drop jet head of the present invention of a case shown in FIG. 6.

In a case shown in FIG. 8, as shown in FIG. 16, four kinds of samples, different only in configuration of the center thick part where the piezoelectric element comes in contact, are used in this simulation. That is, the thin parts are divided at the center thick part as in this embodiment of the present invention, a conventional thick part that has a convex part having the island shape as a comparison example 1 (See FIG. 6), a thick part that has a convex part having the island shape and a narrower width as a comparison example 2, and a thick part which has a convex part having the island shape and a wider width as a comparison example 3 are used in this simulation.

Figure 15:
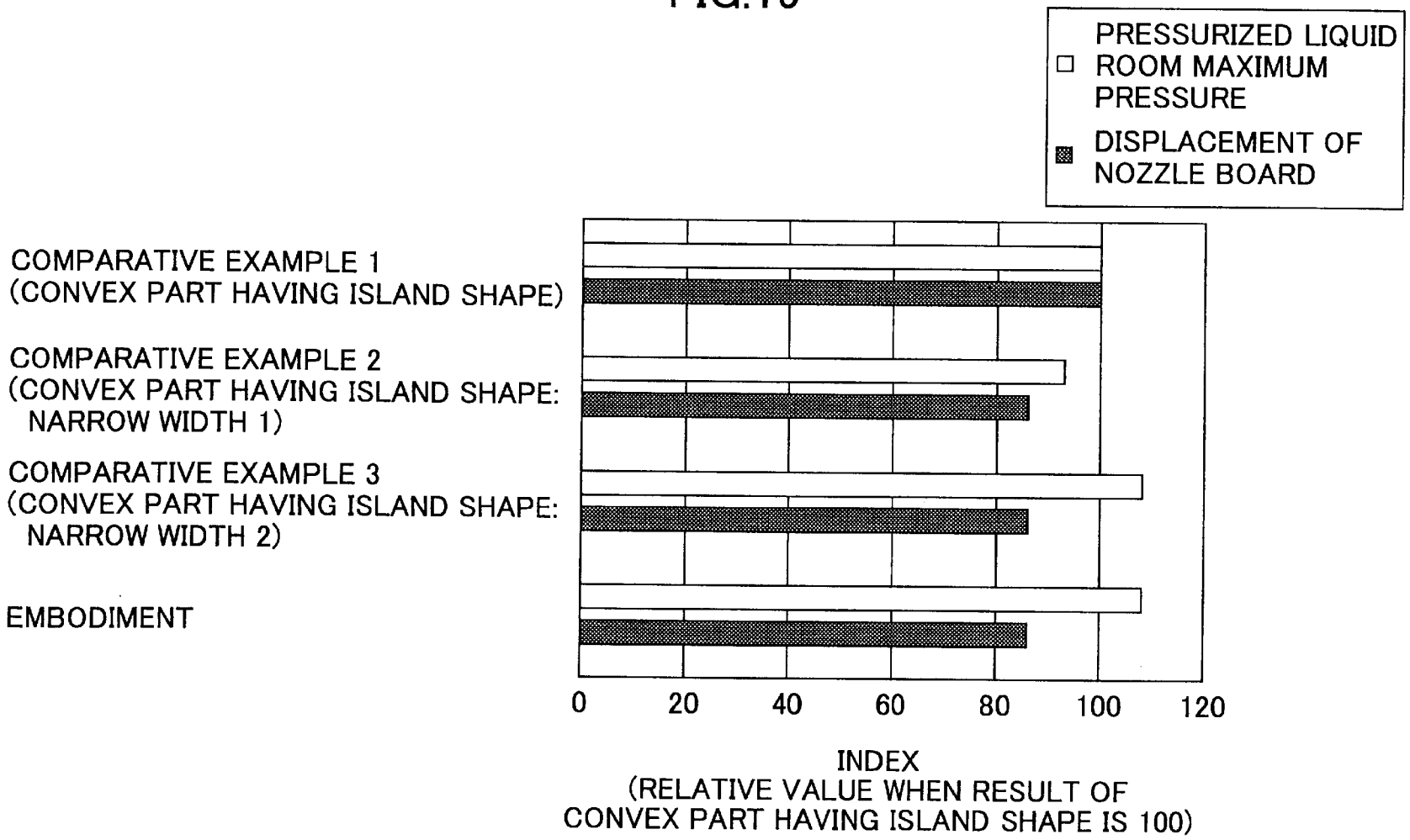
FIG. 15 is a view showing results of the simulation of the liquid drop jet head of the present invention.

Evaluation items in FIGS. 15 and 16 are the maximum value of pressure generated inside of the pressurized liquid room 6 and the maximum value of displacement of the nozzle plate (the nozzle board 3). This is because when the rigidity of the vibration board 2 is too large, the nozzle plate 3 is assumed to move because of displacement of the whole of the pressurized liquid room 6 while the increase of the inside pressure of the pressurized liquid room 6 becomes small.

Results of the above mentioned evaluation are shown in FIGS. 15 and 16. In FIGS. 15 and 16, an index value based on a relative comparison with regard to the result of the comparison example 1, which has a convex part having a conventional island configuration, is expressed on the horizontal axis. What the horizontal axis shows more than 100, it means that the capability is improved.

According to results of the evaluation shown in FIGS. 15 and 16, the inside pressure of the pressurized liquid room 6 increases sufficiently in this embodiment. Since the index value of the displacement of the nozzle plate 3 is less than 100, the amount of the displacement is relatively large compared with the thick part that has the convex part having the island shape. However, there is a no problem because the displacement of the nozzle plate 3 is less than 20%. In the numerical value simulation, since a transient response analysis is implemented by driving the piezoelectric element, a change of the inside pressure of the pressurized liquid room based on a time change is also evaluated that there are no specifically different points with regard to a large phase change and an amount of pressure change.

Therefore, in a case where the contact part where the piezoelectric element 12 comes in contact with the vibration board 2 is made thick, the surrounding of the contact part is not the convex part having the island shape surrounded by the thin part. It is possible to obtain a good capability of a jetting speed of the ink drop and a volume of the jetting drop at a part where the thin part 21 is divided by the thick part 22 formed along the long side direction of the pressurized liquid room 6.

There are the following advantages as compared with the conventional convex part having the island shape. That is, according to the present invention, it is possible to control the amount of displacement of the vibration board with an increase of the area of the thick part. Because of this, it is possible to improve the control of drop jetting by increasing the rigidity of the pressurized liquid room. Furthermore, since the convex part having the island shape is not formed, it is possible to control the amount of capacity displacement of the pressurized liquid room based on a precision measurement of the convex part so that it is possible to reduce scatter of the capability.

Figure 17:
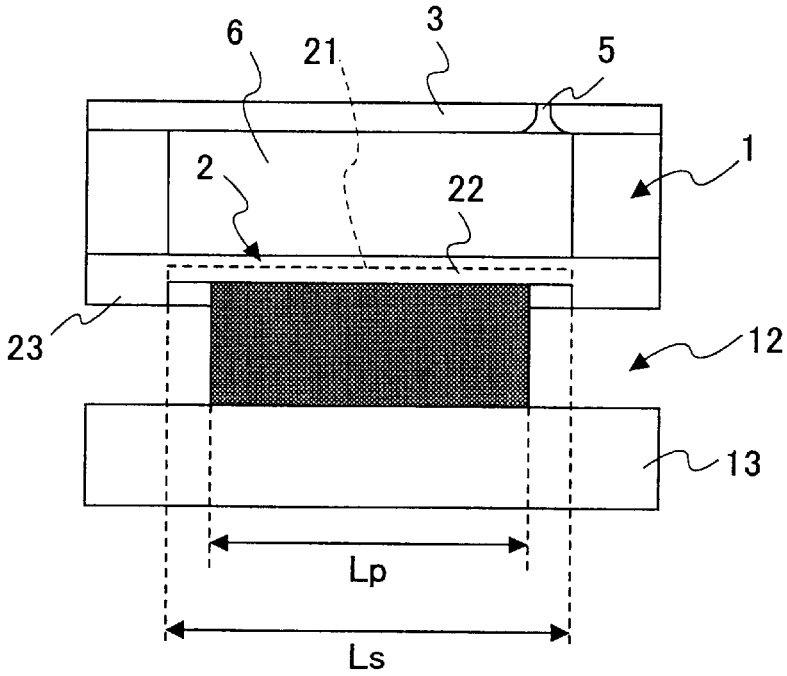
FIG. 17 is a schematic cross sectional view for explaining the piezoelectric element and the length of the thick part in the long side direction of the liquid room.

FIG. 17 is a schematic cross sectional view for explaining the piezoelectric element and the length of the thick part in the long side direction of the liquid room. As shown in FIG. 17, since the area of the thin part 21 formed in the vibration board 2 is small, the rigidity of the pressurized liquid room 6 becomes high. Therefore, the eigen frequency is large so that it is possible to drive with a higher frequency. Furthermore, the inside pressure of the pressurized liquid room 6 can follow the driving displacement of the piezoelectric element 12 precisely so that it is possible to control the inside pressure of the pressurized liquid room 6, namely an ink drop jetting, with high precision. Particularly, in a case where the nozzle 5 is provided at the end part of the pressurized liquid room 6, the rigidity of the vibration board 2 just under the nozzle 5 can be improved because of the existence of the surrounding thick part 23.

It is preferable for the ink jet head to have a higher rigidity in order to avoid an influence of an unnecessary force from outside of the head, such as a vibration at the time of printing, to a part other than the part driven by the piezoelectric element. Therefore, it is preferable for the surrounding thick part 23 other than the part where the piezoelectric element 12 comes in contact (the center thick part 22) to have a greater thickness.

In this case, as shown in FIG. 17, a length Lp in the long side direction of the liquid room at the end part where the piezoelectric element 12 comes in contact with the vibration board 2 is shorter than a length Ls in the long side direction of the liquid room at a part of the center thick part 22 of the vibration board 2 where the piezoelectric element 12 comes in contact.

Furthermore, a positioning gap may occur at the time of connection of the center thick part 22 of the vibration board 2. In order to take measures to meet the above mentioned gap, the length Lp in the long side direction of the liquid room at the end part where the piezoelectric element 12 comes in contact with the vibration board 2 is made shorter than the length Ls in the long side direction of the liquid room at a part of the center thick part 22 of the vibration board 2 where the piezoelectric element 12 comes in contact, as shown in FIG. 17. That is, a length in the long side direction of the liquid room of the thin part 21 is made longer than the length of the piezoelectric element 12. Because of this, even if a position where the center thick part 22 of the vibration board 2 comes in contact with the piezoelectric element 12 is gapped in right and left sides in FIG. 17, it is possible to provide an area where the center thick part 22 of the vibration board 2 comes in contact with the piezoelectric element 12 constantly so as to control scatter variation of a capability.

Furthermore, the length in the long side direction of the liquid room of the center thick part 22 of the part where the piezoelectric element 12 comes in contact is shorter than the length of the pressurized liquid room 6 in the long side direction. Therefore, the thickness of the center thick part 22 is greater than the surrounding thick part 23 so that the rigidity of the ink jet head is improved. Hence, tolerance against a vibration from the outside is improved so that a liquid drop jet head with a high quality can be obtained.

In a case where the part in which the end part of the piezoelectric element 12 comes in contact with the thick part of the vibration board is connected by an adhesive and the thick part has a configuration of the convex part having the island shape as in the conventional art, if some of the adhesive comes out from the part, the adhesive flows out to the surroundings and may invade the area of the thin part. On the other hand, according to the present invention, the area of the center thick area 22 where the piezoelectric element 12 comes in contact is longer and narrower than the piezoelectric element 12. The adhesive that comes out from the part in which the end part of the piezoelectric element 12 comes in contact with the thick part of the vibration board flows along the long side direction of the center thick part 22 so that the adhesive is prevented from flowing out to the thin part 21.

On the other hand, an amount of capacity change of the pressurized liquid room 6, which is an important factor of an amount of ink jetting, is decided based on the amount of displacement of the piezoelectric element 12 and the length of the piezoelectric element 12. In a case where the part in which the piezoelectric element 12 comes in contact with the vibration board 2 is a convex part having the island shape, the length of the convex part is important. If a support member is not provided at a position where the partition (liquid room partition) 20 dividing neighboring pressurized liquid rooms 6 faces to connect the base substrate 13 and the vibration board 2 so that a gap is formed and the only piezoelectric element 12 is provided, it is preferable that a resin is used as a material of the vibration board 2 to provide both the rigidity of the vibration board 2 and the displacement amount of the piezoelectric element 12. However, if the vibration board 2 is formed by resin, it is difficult to form the length of the convex part having the island shape with high precision.

On the other hand, if a support member is not provided at a position where the partition (liquid room partition) 20 dividing neighboring pressurized liquid rooms 6 faces to connect the base substrate 13 and the vibration board 2 so that a gap is formed and the only piezoelectric element 12 is provided and the vibration board 2 is formed by resin material, the convex part having the island shape is not provided in the vibration board 2 so that a desirable ink jet head having little scatter of a capability can be achieved easily.

Figure 18:
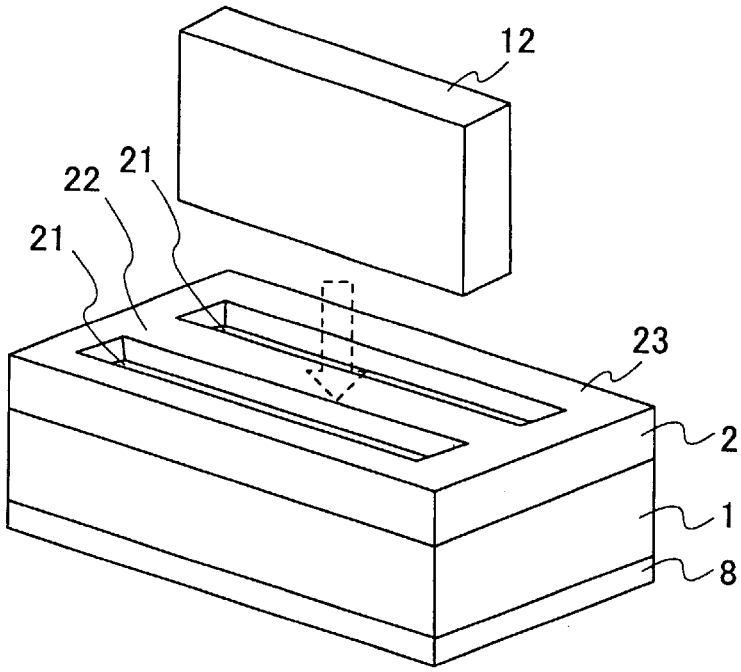
FIG. 18 is a schematic perspective view seen in a direction of the vibration board of a pressurized liquid room in a prior state where the piezoelectric element is not connected.

Next, a second embodiment of the present invention will be described with reference to FIG. 18. FIG. 18 is a schematic perspective view seen in a direction of the vibration board of a pressurized liquid room in a prior state where the piezoelectric element is not connected. In the ink jet head of the second embodiment, the thin part 21, the center thick part 22 and the surrounding part 23 are formed in the vibration board 2 as well as the ink jet head of the first embodiment. However, the ink jet head of the second embodiment is different from the ink jet head of the first embodiment in that the thickness of the center thick part 22 dividing the thin part 21 is same as the thickness of the surrounding thick part 23 divided for each channel.

Under the above mentioned structure, the vibration board 2 has only two kinds of parts, namely a thin portion (the thin part 21) and a thick portion so that the manufacturing process can be simplified and a reduction of the cost and precision of manufacturing can be improved.

In the ink jet head of the second embodiment of the present invention, as well as the ink jet head of the first embodiment, the piezoelectric element 12 is connected to the center thick part 22 and the piezoelectric element 12 is expanded and contracted so that the inside pressure of the pressurized liquid room 6 is controlled properly and the ink drop is jetted. Since the displacement of the piezoelectric element 12 make the center thick part 22 displace, the efficiency of the piezoelectric element 12 improves in a case where the rigidity of the center thick part 22 is low, namely the thickness of the center thick part 22 is thin. However, if the center thick part 22 has a small thickness, the thickness of the surrounding thick part 23 may become thin so that a rigidity of the whole of the head may become small. However, since the vibration board 2 is connected to the path forming substrate 1 or the head frame 17 not shown in FIG. 18, the reduction of the rigidity of whole of the head can be prevented by making the connection part rigid.

The piezoelectric element 12 is driven so that the vibration board 2 increases or decreases the inside pressure of the pressurized liquid room 6. Hence, the distance between the base substrate 13 and the vibration board 2 can be expanded and contracted. Since driving with a low voltage is preferable, it is preferable that a stacked type piezoelectric element in which a plurality of layers of piezoelectric material and electrode material are stacked reciprocally is used. In this case, the above described action and effect can be achieved by using either d31 or d33 as a piezoelectric direction.

Figure 19:
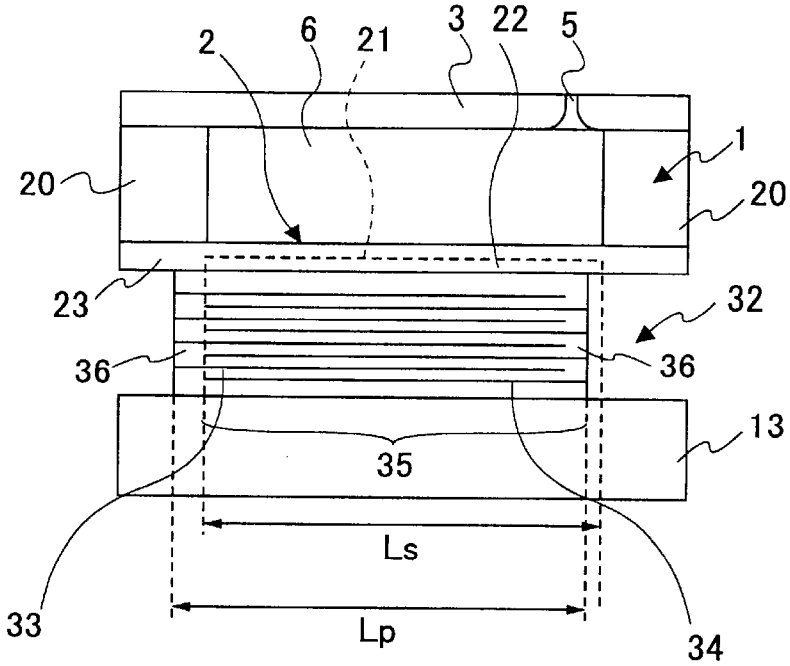
FIG. 19 is a expanded schematic cross sectional view of a part along the long side direction of the liquid room of the third embodiment of the present invention.

The third embodiment of the present invention in which d33 displacement is used will be described with reference to FIG. 19. FIG. 19 is an expanded schematic cross sectional view of a part along the long side direction of the liquid room of the third embodiment of the present invention. A piezoelectric element 32 of the ink jet head is a stacked type piezoelectric element in which a piezoelectric layer 33 and an electrode layer (inside electrode) 34 are stacked reciprocally. The inside electrode 33 is pulled out from opposite end surfaces reciprocally. In the piezoelectric element 32, an area where the piezoelectric layer 33 is put between the inside electrodes 34 is an active area 35 where an electrical field is generated so that a displacement is generated. The electrode 34 is provided from one end but not provided to another end of the piezoelectric element 32 in the long side direction of the liquid room. Accordingly, even if a voltage is applied to both ends, a displacement is not generated at both ends. That is to say, both ends are inactive areas 36.

One of the inactive areas 36 of the piezoelectric element 32 in which the d33 displacement is used is arranged at a position facing the partition 20 (including the outside wall part) dividing the pressurized liquid rooms 6. In this case, either a length Lp of the piezoelectric element 32 or a length Ls of the center thick part 22 may be longer. The displacement of the piezoelectric element 32 in the vicinity of the inactive area 36 in the active area 35 is small. Hence, this does not influence the control of the piezoelectric element 32 by the partition 20.

Thus, one of the inactive areas 36 of the piezoelectric element 32 is controlled by the partition 20. Hence, even if a positioning gap is generated at the time of connection of the piezoelectric element 32 and the vibration board 2, a gap in the displacement area of the vibration board 2 becomes small so that scatter of the capability can be controlled.

Figure 20:
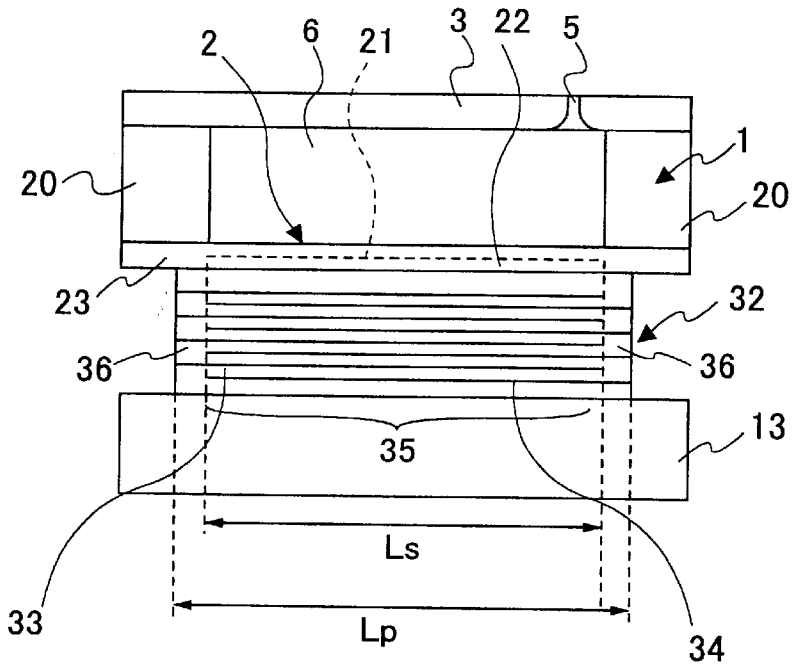
FIG. 20 is a schematic cross sectional view of the ink jet head along the long side direction of the liquid room of the fourth embodiment of the present invention.

The fourth embodiment of the present invention will be described with reference to FIG. 20. FIG. 20 is a schematic cross sectional view of the ink jet head along the long side direction of the liquid room of the fourth embodiment of the present invention.

Respective inactive areas 36 of the piezoelectric element 32 are arranged at a position facing the partition 20 (including the outside wall part) dividing the pressurized liquid rooms 6. In this case, a length Lp of the piezoelectric element 32 is longer than a length Ls of the center thick part 22. The displacement of the piezoelectric element 32 in the vicinity of the inactive area 36 in the active area 35 is small. Hence, this does not influence the control of the piezoelectric element 32 by the partition 20. Rather, the inactive areas 36 of the piezoelectric element 32 function as support members connecting the base substrate 13 and the vibration board 2 so that the path forming substrate 1 is fixed tightly so that rigidity of the whole of the head can be improved.

If the active area 35 of the piezoelectric element 32 does not exist at a position facing the partition 20 in both sides of the long side direction dividing the pressurized liquid room 6, the partition 20 does not receive the displacement at the time of driving the piezoelectric element 32. Hence, an unnecessary vibration displacement is not generated at the pressurized liquid room 6 so that displacement efficiency of the piezoelectric element 32 is not blocked.

Figure 21:
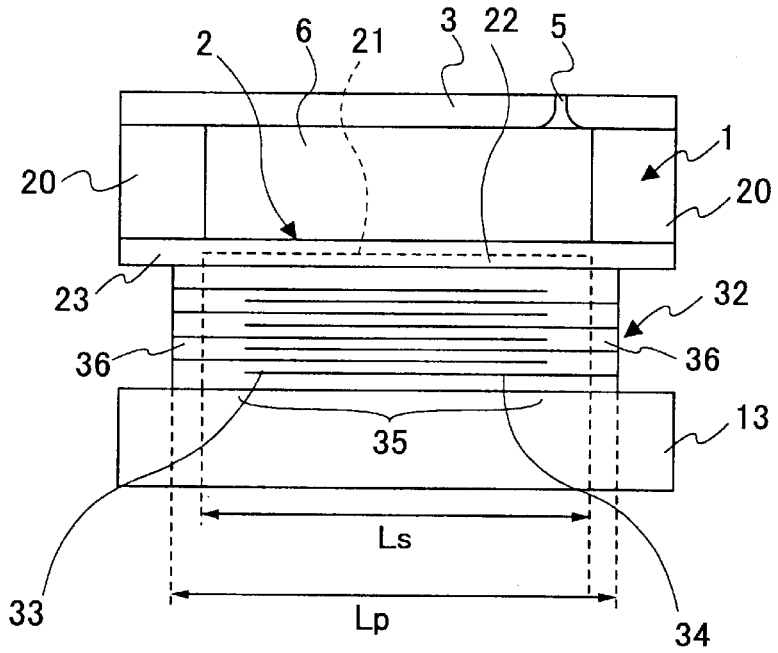
FIG. 21 is a schematic cross sectional view of the ink jet head along the long side direction of the liquid room of the fifth embodiment of the present invention.

The fifth embodiment of the present invention will be described with reference to FIG. 21. FIG. 21 is a schematic cross sectional view of the ink jet head along the long side direction of the liquid room of the fifth embodiment of the present invention.

In the ink jet head of the fifth embodiment of the present invention, the length of the piezoelectric element 32 in the long side direction of the active area 35 is shorter than the length of the vibration board 2 in the long side direction of the center thick part 22 so that the inactive area 36 enters in an area corresponding to the center thick part 22.

That is, respective inactive areas 36 of the piezoelectric element 32 are arranged at a position facing the partition 20 (including the outside wall part) dividing the pressurized liquid rooms 6. In addition, the inactive areas 36 are provided in areas where the vibration board 2 is displaced by displacement of the active area 35. In this case, the length Lp of the piezoelectric element 32 is longer than the length Ls of the center thick part 22.

Since the displacement of the piezoelectric element 32 in the inactive area 36 is very small, the inactive areas 36 of the piezoelectric element 32 function as a support member connecting the base substrate 13 and the vibration board 2. Hence, it is possible to fix the path forming substrate 1 tightly. Furthermore, even if a positioning gap is generated at the time of contact of the piezoelectric element 32 and the vibration board 2, the size of the active area 35 of the piezoelectric element 32 inside of the long side of the pressurized liquid room 6 is not changed so that scatter of the capability can be controlled.

Figure 22:
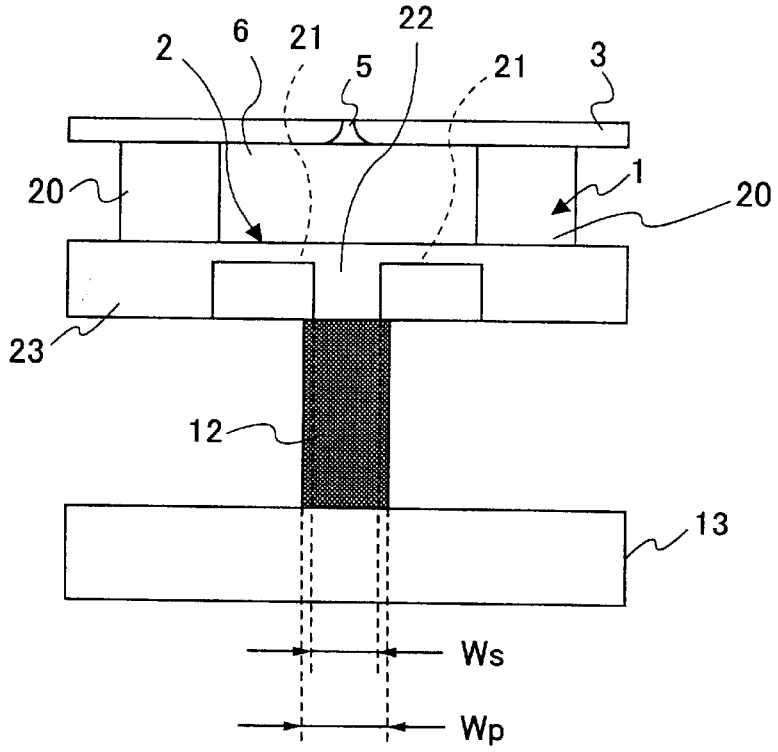
FIG. 22 is a schematic cross sectional view of the ink jet head along the long side direction of the liquid room of the six embodiment of the present invention.

The sixth embodiment of the present invention will be described with reference to FIG. 22. FIG. 22 is a schematic cross sectional view of the ink jet head along the long side direction of the liquid room of the fifth embodiment of the present invention. Here, the sixth embodiment of a case shown in FIG. 6 is shown in FIG. 23.

Figure 23:
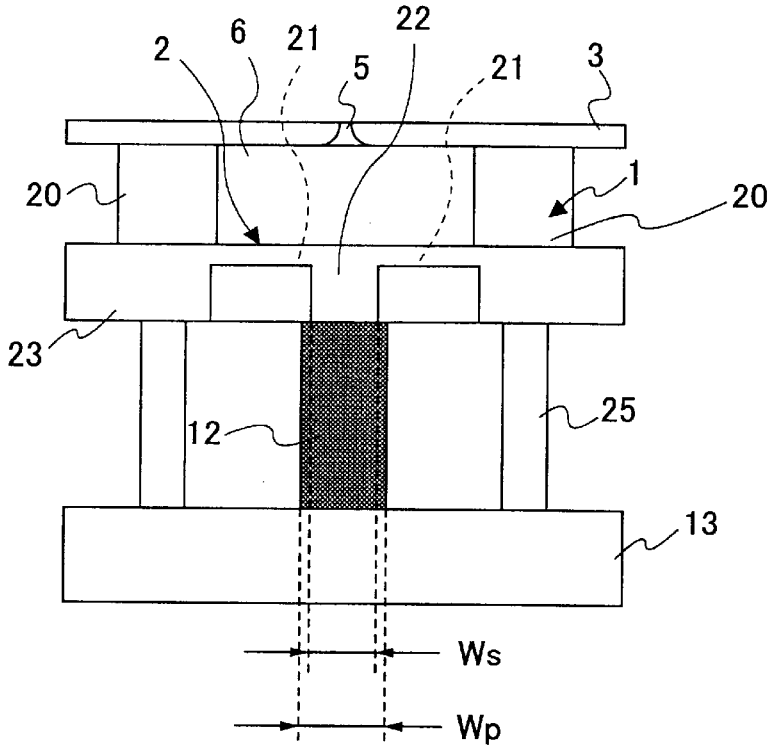
FIG. 23 is a schematic cross sectional view of the ink jet head along the long side direction of the liquid room of the sixth embodiment of a case shown in FIG. 6.

Referring to FIGS. 22 and 23, the length (width) Wp in the short side direction of the pressurized liquid room 6 where the piezoelectric element 12 comes in contact with the vibration board 2 is shorter than a length (width) Ws of the center thick part 22 in the short side direction of the pressurized liquid room 6 at.

Because of the above mentioned structure, even if a position where the center thick part 23 of the vibration board 2 comes in contact with the piezoelectric element 12 is gapped in right and left sides in FIG. 22, it is possible to secure an area where the center thick part 23 of the vibration board 2 comes in contact with the piezoelectric element 12 constantly so as to control the scatter of a capability.

Figure 24:
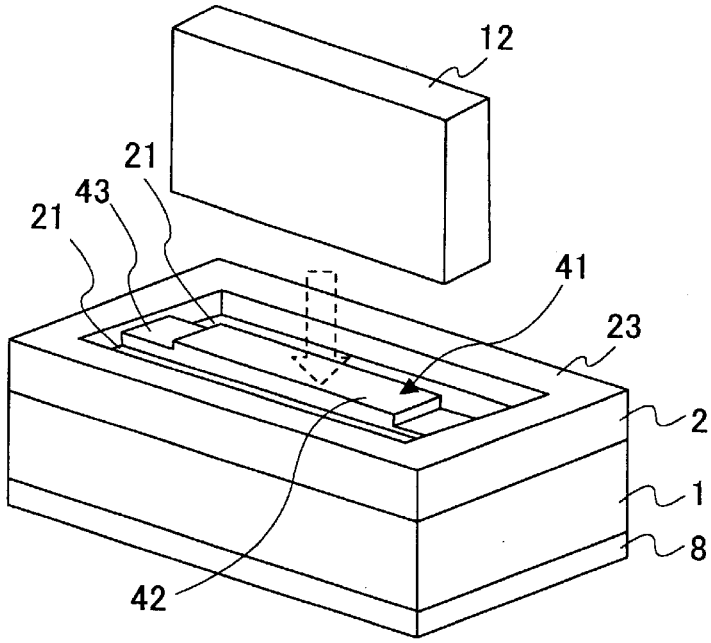
FIG. 24 is a schematically perspective view seen in a direction of the vibration board of a pressurized liquid room in a prior state where the piezoelectric element is not connected.

The seventh embodiment of the present invention will be described with reference to FIG. 24. FIG. 24 is a schematic perspective view seen in a direction of the vibration board of a pressurized liquid room in a prior state where the piezoelectric element is not connected.

The vibration board 2 includes the thin part 21, a center thick part 41, and the surrounding thick part 23. The seventh embodiment of the present invention is different from the second embodiment in the following points. A first center thick parts 42 is provided along the long side direction of the pressurized liquid room and divides the thin part 21. The first center thick part 42 comes in contact with the piezoelectric element 12. The center thick part 41 includes a second thick part 43 connecting to the surrounding thick part 23. The thickness of the second thick part 43 is different from the thickness of the thin part 21.

The center thick part 41 in this embodiment is different from the conventional convex part having the island shape in that the center thick part 41 is not surrounded by the thin part 21 having a constant thickness. Therefore, when the piezoelectric element 12 is expanded and contracted, a maximum stress generated at the vibration board 2 can be made small by providing the second thick part 43. In addition, the rigidity of the whole pressurized liquid room 6 can be secured without reducing the efficiency of the piezoelectric element 12.

Figure 25:
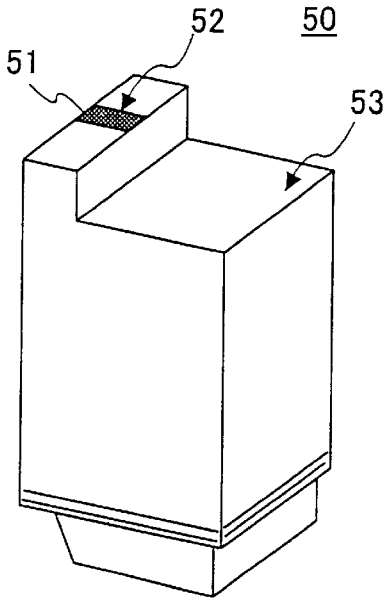
FIG. 25 is a perspective view of an ink cartridge united with an ink jet head with respect to the eighth embodiment of the present invention.

The eighth embodiment of the present invention will be described with reference to FIG. 25. FIG. 25 is a perspective view of an ink cartridge united with an ink jet head with respect to the eighth embodiment of the present invention. In the eighth embodiment of the present invention, the present invention is applied to a head part of the ink cartridge united with the ink jet head. The ink cartridge 50 is formed by unifying the ink jet head 52 having the nozzle and others in the above mentioned respective embodiments and an ink tank 53 for supplying the ink to the ink jet head 52.

Figure 26:
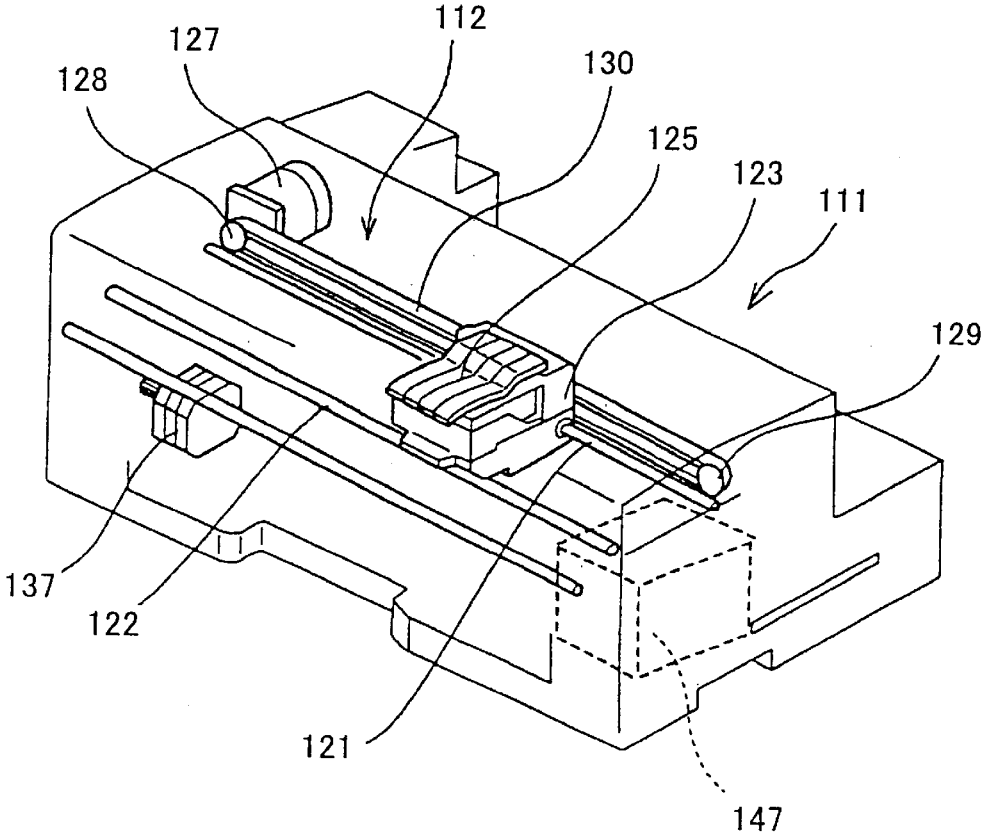
FIG. 26 is a perspective view of an ink jet recording apparatus in which the ink jet head of the present invention is mounted.
Figure 27:
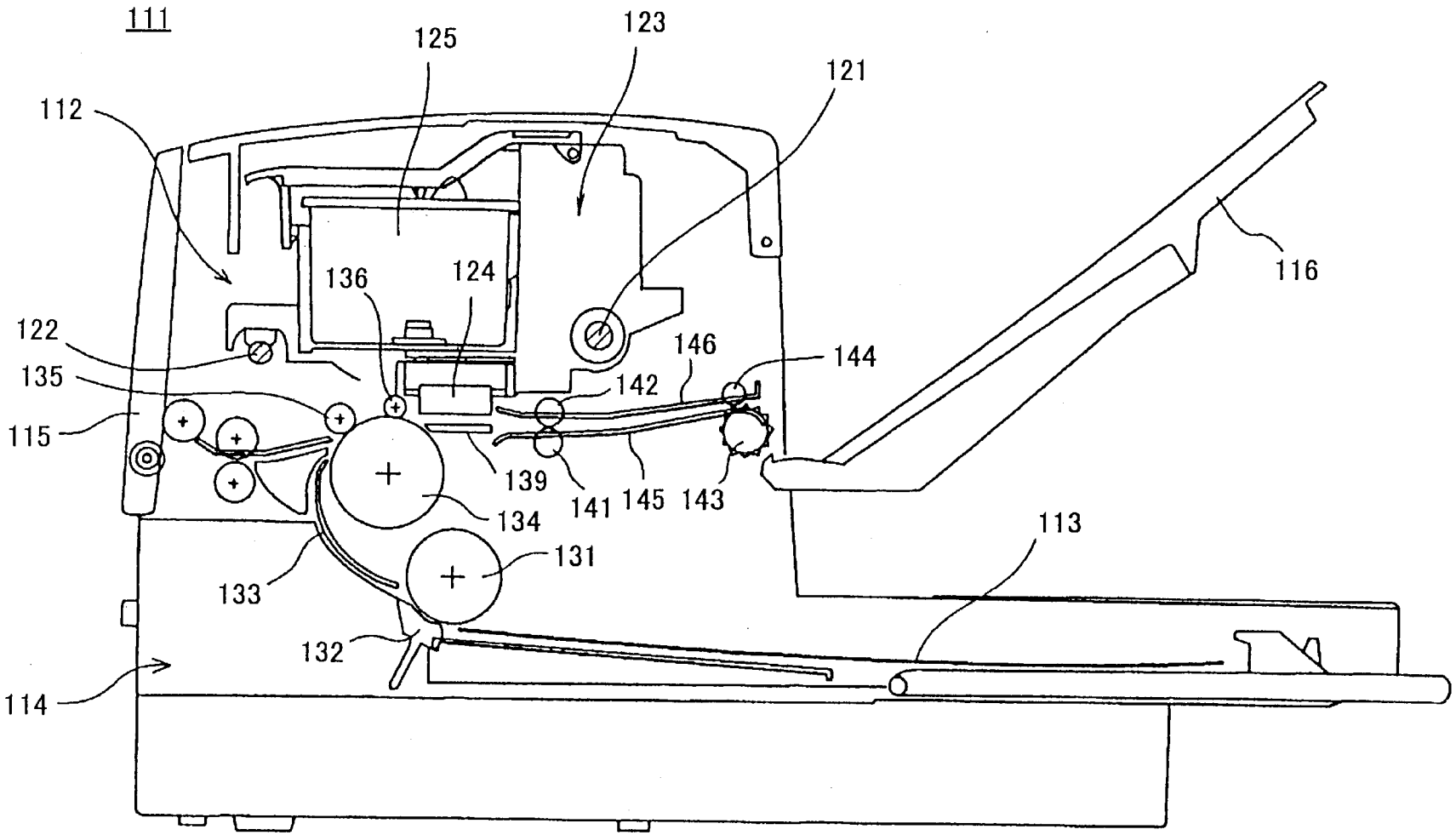
FIG. 27 is a sectional view of a mechanism part of the ink jet recording apparatus in which the ink jet head of the present invention is mounted.

Next, an ink jet recording apparatus in which the ink jet head of the present invention is used will be described with reference to FIGS. 26 and 27. FIG. 26 is a perspective view of an ink jet recording apparatus in which the ink jet head of the present invention is mounted. FIG. 27 is a sectional view of a mechanism part of the ink jet recording apparatus in which the ink jet head of the present invention is mounted.

The ink jet recording apparatus includes a recording apparatus body part 111 and a printing mechanism part 112. The printing mechanism part 112 is housed in the recording apparatus body part 111. A carriage movable in the main scanning direction, a recording head comprising the ink jet head of the present invention mounted on the carriage, the ink cartridge for supplying the ink to the recording head, and others are housed in the printing mechanism part 112. A paper supply cassette 114 (or a paper supply tray) capable of loading a lot of paper 113 from a front side can be connected detachably at a lower part of the recording apparatus body part 111. In addition, a manual paper supply cassette 115 for supplying the paper 113 manually can be opened at the lower part of the recording apparatus body part 111. The paper 113 is taken from the paper supply cassette 114 or the manual paper supply cassette 115 in the printing mechanism part 112. A picture is recorded by the printing mechanism part 112 and then discharged to the paper discharge tray 116 connected to a back surface side of the recording apparatus body part 111.

In the printing mechanism part 112, a carriage 123 is held slidably in a main scanning direction namely a direction perpendicular to the paper of FIG. 25 by a guide member. The guide member is connected to left and right side boards not shown in FIG. 25. The guide member includes a main guide rod 121 and a sub guide rod 122. In the carriage 123, a recording head 124 is arranged in a direction where plural ink jet opening parts (nozzles) cross in the main scanning direction. Ink drops having colors of yellow, cyan, magenta, and black, for example, are jetted by the ink jet head. The recording head 124 is mounted in a state where the direction of the ink jet faces downward. In the carriage 123, respective ink cartridges 125 supplying ink having the respective colors to the recording head 124 are connected detachably.

An air opening connected to the air opening part is provided at an upper part of the ink cartridge 125. A supply opening part supplying the ink to the ink jet head is provided at a lower part of the ink cartridge 125. The ink is supplied to the ink jet head by a capillary of a porous body maintaining a slightly negative pressure.

Although the head 124 for the respective colors is used as the recording head in this embodiment, one head having a nozzle jetting the respective colors may be used.

The back side, namely the lower side in the paper carriage direction, of the carriage 123 is clamped by the main guide rod 121 slideably. In addition, the front side, namely the upper side in a paper carriage direction, of the carriage 123 is connected by the sub guide rod 122 slideably. In order to make the carriage 123 move to scan in the main scanning direction, a timing belt 130 is stretch-connected between a driving pulley 128 rotationally driven by the main scan motor 127 and a driven pulley 129. The timing belt 130 is fixed at the carriage 123 and the carriage moves and returns by forward and backward rotations of the main scan motor 127.

On the other hand, in order to carry the paper 113 set at the paper supply cassette 114 to the lower side of the recording head 124, a supply paper roller 131, a friction pad 132, a guide member 133, a carry roller 134, a small roller 135, and a head end roller 136 are provided in the ink jet recording apparatus separately. Each of the sheets of paper 113 is carried from the supply paper cassette 114. The paper 113 is guided by the guide member 133. The paper 113 is carried by turning over with the carry roller 134. The small roller 135 is pushed on a circumference surface of the carry roller 134. A pushing angle on the paper 113 by the carry roller 134 is determined by the head end roller 136. The carry roller 134 is rotationally driven by a sub scan motor 137 with a gear line.

The paper 113 pushed by the carry roller 134 corresponding to a moving area in the main scanning direction of the carriage 123 is received by a print receiving member 139 as a paper guide member guiding in a lower direction of the recording head 124. A carry roller 141 rotationally driven to carry the paper 113 in a discharge paper direction and a spur 142, a discharge paper roller 143 for carrying the paper 113 to the paper discharge tray 116, a spur 144, and guide members 145 and 146 forming a paper discharge route are provided at the lower side of the paper carry direction of the print receiving member 139.

At the time of recording, the recording head 124 is driven based on a picture signal and the carriage 123 is moved. The ink is jetted to the paper 113 which does not move so that one line is recorded on the paper 113. After that, the paper 113 is moved a designated distance and the next line is recorded. The recording operation is finished by receiving a record finishing signal or a signal indicating that the rear end part of the paper 113 has arrived at the recording area, so that the paper 113 is discharged. In this case, controllability of an ink drop jetting by the ink jet head of the present invention forming the head 124 is improved and a change of a capability is controlled so that it is possible to stably record a picture having high quality.

A recovery apparatus 147 for recovering from a jetting malfunction of the recording head 124 is arranged at an outside position of the recording area, namely the right end side of the moving direction of the carriage 123. The recovery apparatus 147 includes a cap means, an absorption means, and a cleaning means. During waiting for ready for printing, the carriage 123 is moved to the side of the recovery apparatus 147. The recording head 124 is capped by the cap means. The jetting malfunction based on an ink dry condition can be prevented by maintaining the jet opening part in a wet state. In addition, the ink not used for recording is jetted during recording so that ink viscosities of all of the jet opening parts are kept constant, and thereby a stable jetting ability can be maintained.

In a case where a jetting malfunction occurs, the jet opening part such as the nozzle of the head 94 is sealed by the cap means. The bubble with the ink is absorbed from the jet opening part through a tube by the absorption means. The ink, the dust or the like that adheres to the jet opening surface is removed by the cleaning means so that jetting malfunction is covered. In addition, the ink that is absorbed is discharged to a waste ink saver arranged at a lower part of the body but not shown in FIG. 25 so that the ink is absorbed and maintained by an ink absorption body inside of the waste ink saver.

The present invention is not limited to these embodiments, but variations and modifications may be made without departing from the scope of the present invention.

For instance, although the present invention is applied to the ink jet head as a liquid drop jet head in the above embodiments, the present invention can be applied to a liquid drop jet head other than the ink jet head such as a liquid drop jet head jetting a liquid resist as a liquid drop or a liquid drop jet head jetting a test material of DNA as a liquid drop.

Furthermore, although the present invention is applied to a side shooter type head by which the displacement direction of the vibration board is the same as the jetting direction of liquid drops in the above embodiments, the present invention can be applied to an edge shooter type head in which the displacement direction of the vibration board is perpendicular to the jetting direction of the liquid drops.

This patent application is based on Japanese priority patent application No. 2001-208098 filed on Jul. 9, 2001 and Japanese priority patent application No. 2001-208276 filed on Jul. 9, 2001, the entire contents of which are hereby incorporated by reference.

What is claimed is:

1. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part and an area of the thin part is divided into two unconnected thin parts by the thick part with which the driving means comes in contact.

2. The liquid drop jet head as claimed in claim 1, wherein the thick part projects to a side where the driving means facing the liquid room comes in contact.

3. The liquid drop jet head as claimed in claim 2, wherein the thick part is provided along a long side direction of the liquid room.

4. The liquid drop jet head as claimed in claim 3, wherein the thin part whose area is divided by the thick part has a long and narrow configuration along the long side direction of the liquid room.

5. The liquid drop jet head as claimed in claim 1, wherein the area of the thin part is formed at a symmetrical position from the thick part.

6. The liquid drop jet head as claimed in claim 1, wherein the thick part of the vibration board surrounded by the thin part has a substantially constant thickness.

7. The liquid drop jet head as claimed in claim 1, wherein the driving means comprises a piezoelectric element whose displacement in a normal direction of the vibration board is in a d33 direction.

8. The liquid drop jet head as claimed in claim 7, wherein the piezoelectric element has a structure in which a plurality of layers of piezoelectric elements and electrode layers are stacked, and an end part in the long side direction of the liquid room has an inactive area where an electric field is not generated and which faces and comes in contact with the partition of the liquid room.

9. The liquid drop jet head as claimed in 8, wherein the inactive area of the piezoelectric element faces and comes in contact with the partition of both ends in the long side direction of the liquid room.

10. The liquid drop jet head as claimed in claim 8, wherein an active area of the piezoelectric element does not exist in an area facing the partition of both ends in the long side direction of the liquid room.

11. The liquid drop jet head as claimed in claim 1, wherein the thick part of the vibration board comprises a first thick part with which the driving means comes in contact and a second thick part having a different thickness from the thin part and connected to the first thick part and the partition of the liquid room.

12. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part and an area of the thin part is divided into two unconnected thin parts by the thick part with which the driving means comes in contact, and a length of the thin part in the long side direction of the liquid room is longer than the length of the driving means that comes in contact with the thick part in the long side direction of the liquid room.

13. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and an inactive area of the piezoelectric element exists in an area facing a driving area of the vibration board.

14. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and the piezoelectric element has a structure in which a length in the long side direction of the liquid room at a position where an end part of the piezoelectric element comes in contact with the vibration board is shorter than a length in the long side direction of the liquid room.

15. The liquid drop jet head as claimed in claim 14, wherein the piezoelectric element has a structure in which the length of the piezoelectric element in the long side direction of the liquid room at a position where the piezoelectric element comes in contact with the vibration board is shorter than a length of the thick part of the vibration board in the long side direction of the liquid room.

16. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and the piezoelectric element has a structure in which the length of the piezoelectric element in a short side direction of the liquid room at a position where the piezoelectric element comes in contact with the vibration board is longer than a length of the thick part of the vibration board in the short side direction of the liquid room.

17. An ink jet recording apparatus, comprising an ink jet head jetting an ink drop, the ink jet head including:

a nozzle jetting the ink drop;

a liquid room connected to the nozzle;

a vibration board forming a wall surface of at least a part of the liquid room;

driving means generating a pressure pressuring liquid ink provided in the liquid room by coming in contact with the vibration board;

a support substrate to which an end part of the driving means is connected without connecting to the vibration board; and a gap between the support substrate and the vibration board at a position corresponding to a partition of the liquid room, wherein the vibration board comprises a thin part and a thick part, and an area of the thin part is divided into two unconnected thin parts by the thick part with which the driving means comes in contact.

18. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a support member connecting the support substrate and the vibration board at a position corresponding to a partition of the liquid room, wherein the vibration board comprises a thin part and a thick part and an area of the thin part is divided into two unconnected thin parts by the thick part with which the driving means comes in contact.

19. The liquid drop jet head as claimed in claim 18, wherein the thick part projects to a side where the driving means facing the liquid room comes in contact.

20. The liquid drop jet head as claimed in claim 19, wherein the thick part is provided along a long side direction of the liquid room.

21. The liquid drop jet head as claimed in claim 20, wherein the thin part whose area is divided by the thick part has a long and narrow configuration along the long side direction of the liquid room.

22. The liquid drop jet head as claimed in claim 18, wherein the area of the thin part is formed at a symmetrical position from the thick part.

23. The liquid drop jet head as claimed in claim 18, wherein the thick part of the vibration board surrounded by the thin part has a substantially constant thickness.

24. The liquid drop jet head as claimed in claim 18, wherein the driving means comprises a piezoelectric element whose displacement in a normal direction of the vibration board is in a d33 direction.

25. The liquid drop jet head as claimed in claim 24, wherein the piezoelectric element has a structure in which a plurality of layers of piezoelectric elements and electrode layers are stacked, and an end part in the long side direction of the liquid room has an inactive area where an electric field is not generated and which faces and comes in contact with the partition of the liquid room.

26. The liquid drop jet head as claimed in claim 25, wherein the inactive area of the piezoelectric element faces and comes in contact with the partition of both ends in the long side direction of the liquid room.

27. The liquid drop jet head as claimed in claim 25, wherein an active area of the piezoelectric element does not exist in an area facing the partition of both ends in the long side direction of the liquid room.

28. The liquid drop jet head as claimed in claim 18, wherein the thick part of the vibration board comprises a first thick part with which the driving means comes in contact and a second thick part having a different thickness from the thin part and connected to the first thick part and the partition of the liquid room.

29. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a support member connecting the support substrate and the vibration board at a position corresponding to a partition of the liquid room, wherein the vibration board comprises a thin part and a thick part and an area of the thin part is divided into two unconnected thin parts by the thick part with which the driving means comes in contact, and a length of the thin part in the long side direction of the liquid room is longer than a length of the driving means that comes in contact with the thick part in the long side direction of the liquid room.

30. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a support member connecting the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and an inactive area of the piezoelectric element exists in an area facing a driving area of the vibration board.

31. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a support member connecting the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and the piezoelectric element has a structure in which a length in the long side direction of the liquid room at a position where an end part of the piezoelectric element comes in contact with the vibration board is shorter than a length in the long side direction of the liquid room.

32. The liquid drop jet head as claimed in claim 31, wherein the piezoelectric element has a structure in which the length of the piezoelectric element in the long side direction of the liquid room at a position where the piezoelectric element comes in contact with the vibration board is shorter than a length of the thick part of the vibration board in the long side direction of the liquid room.

33. A liquid drop jet head, comprising:

a nozzle jetting a liquid drop;

a liquid room connected to the nozzle;

a vibration board forming a wall surface of at least a part of the liquid room;

driving means generating a pressure pressuring a liquid provided in the liquid room by coming in contact with the vibration board;

a support substrate to which an end part of the driving means is connected without connecting to the vibration board; and a support member connecting the support substrate and the vibration board at a position corresponding to a partition of the liquid room, wherein the vibration board comprises a thin part and a thick part and an area of the thin part is divided into two unconnected thin parts by the thick part with which the driving means comes in contact, the driving means comprises a piezoelectric element, and the piezoelectric element has a structure in which a length of the piezoelectric element in a short side direction of the liquid room at a position where the piezoelectric element comes in contact with the vibration board is longer than a length of the thick part of the vibration board in the short side direction of the liquid room.

34. An ink jet recording apparatus, comprising an ink jet head jetting an ink drop, the ink jet head including:

a nozzle jetting the ink drop;

a liquid room connected to the nozzle;

a vibration board forming a wall surface of at least a part of the liquid room;

driving means generating a pressure pressuring liquid ink provided in the liquid room by coming in contact with the vibration board;

a support substrate to which an end part of the driving means is connected without connecting to the vibration board; and a support member connecting the substrate and the vibration board at a position corresponding to a partition of the liquid room, wherein the vibration board comprises a thin part and a thick part, and an area of the thin part is divided into two unconnected thin parts by the thick part with which the driving means comes in contact.

* * * * *